US006280916B1

(12) United States Patent
Roberts

(10) Patent No.: US 6,280,916 B1
(45) Date of Patent: Aug. 28, 2001

(54) SILVER HALIDE REFLECTION SUPPORT PRINT MEDIA

(75) Inventor: Michael R. Roberts, Rochester, NY (US)

(73) Assignee: Eastman Kodak Company, Rochester, NY (US)

( * ) Notice: Subject to any disclaimer, the term of this patent is extended or adjusted under 35 U.S.C. 154(b) by 0 days.

(21) Appl. No.: 09/472,576

(22) Filed: Dec. 27, 1999

(51) Int. Cl.[7] ..... G03C 1/46

(52) U.S. Cl. ..... 430/505; 430/502; 430/503; 430/523; 430/531; 430/533; 430/543; 430/558; 430/567; 430/604; 430/605

(58) Field of Search ..... 430/505, 503, 430/502, 523, 531, 533, 543, 558, 567, 604, 605

(56) References Cited

U.S. PATENT DOCUMENTS

| | | | |
|---|---|---|---|
| 4,040,829 | | 8/1977 | Ohmatsu et al. . |
| 4,528,311 | | 7/1985 | Beard et al. . |
| 5,142,712 | | 9/1992 | Hennessy . |
| 5,384,235 | | 1/1995 | Chen et al. . |
| 5,385,815 | | 1/1995 | Schofield et al. . |
| 5,576,159 | | 11/1996 | Sato et al. . |
| 5,610,000 | | 3/1997 | Vishwakarma et al. . |
| 5,674,670 | | 10/1997 | Vishwakarma et al. . |
| 5,736,303 | | 4/1998 | McSweeney et al. . |
| 5,744,287 | | 4/1998 | Roberts et al. . |
| 5,792,597 | | 8/1998 | Kawai . |
| 5,888,706 | * | 8/2000 | Merrill et al. ..... 430/503 |
| 5,891,607 | * | 4/1999 | Brewer et al. ..... 430/503 |
| 6,107,018 | * | 8/2000 | Mydlarz et al. ..... 430/567 |

FOREIGN PATENT DOCUMENTS

| | | |
|---|---|---|
| 285206 A5 | 12/1990 | (DE) . |
| 0 062 202 | 10/1982 | (EP) . |
| 53/65730 | 6/1978 | (JP) . |

OTHER PUBLICATIONS

Research Disclosure, May 1991, #32592, "Polymerisable UV–absorbers Used in Photography".

* cited by examiner

*Primary Examiner*—Geraldine Letscher
(74) *Attorney, Agent, or Firm*—Paul A. Leipold

(57) ABSTRACT

The invention relates to a multilayer photographic element comprising a reflective support wherein the color record 1 adjacent to the support comprises at least one light sensitive layer and a non-light sensitive dye-forming interlayer; and wherein color record 2 above said color record 1 comprises at least one light sensitive layer and at least two non-light sensitive dye-forming interlayers and wherein color record 3 comprises at least one light sensitive layer and a non-light sensitive dye-forming interlayer; an optional UV dye containing interlayer; and top overcoat; and wherein each interlayer is substantially scavenger free, silver halide grains comprising greater than 90% silver chloride, and wherein the reciprocity characteristics of the silver halide grains are such that for a separation exposure of 1 microsecond and 0.4 sec, each color record develops to a density of at least 2.0 within a log exposure range of 1.2 or less relative to the exposure point producing a density 0.04 above Dmin.

14 Claims, 1 Drawing Sheet

SILVER HALIDE REFLECTION SUPPORT PRINT MEDIA

FIELD OF THE INVENTION

This invention relates to a new multilayer structure for photographic silver halide color print media, useful for both conventional and digital printing applications. In particular, it relates to the photographic response, or characteristic dye curves, that provides good image quality after exposure and development and to improved silver efficiency.

BACKGROUND OF THE INVENTION

The continuing thrust towards digital printing of photographic color papers has created the need for a consumer color paper that can work in both a negative working optical and digital exposure equipment. In order for a color paper to correctly print, utilizing a color negative curve shape of the paper is critical. In a digital environment (direct writing) to a photographic paper, the curve shape to a degree can be electromodulated and thus have a greater degree of freedom than the color negative working system. Ideally, a color paper that could substantially maintain tone scale from conventional optical negative working exposure times to sub microsecond digital direct writing exposure times would be preferred. This would enable a photofinishing area to maintain one paper for both digital and optical exposure thereby reducing the need for expensive inventory.

Typical photographic color print media comprises a multilayer structure having three light sensitive silver halide image recording layers, as well as other non-light sensitive interlayers. The image recording layers typically comprise silver halide and a dye-forming coupler. During photographic processing the silver halide reacts with developer to form oxidized developer (Dox) that undergoes further reaction with coupler to produce image dye, preferably in the same image recording layer in which the Dox is formed. Because Dox can migrate to other layers in the structure, it is possible for it to react with the wrong coupler and form unwanted dye. The term "chemical cross talk" refers to the formation of unwanted dye caused by migration of oxidized developer from one image recording layer to another. One aspect of interimage in photographic paper relates to the propensity of chemical cross talk occurring during development. Papers with high interimage show degraded color reproduction and have a more restricted color gamut (range of accessible colors) relative to a paper having low interimage that produces the same image dyes. To control cross talk image recording layers are surrounded by non-light sensitive interlayers that contain reactive chemicals known in the trade as "scavengers", organic compounds that convert oxidized developer back to developer, or a noncolored by-product before the oxidized developer can migrate to an adjacent color record and form unwanted dye.

Scavengers are typically organic reducing agents, including but not limited to, compounds known in the trade as hydroquinones and their derivatives.

A limitation of organic reducing agents as interlayer scavengers is their reactivity with image dye after photographic processing. Because scavengers are retained in the coating after photographic processing, conditions that promote diffusion of the scavenger into a dye-containing layer may lead to dye destruction due to reaction of the scavenger with the dye to form colorless by-products. Common surface treatments, such as embossing, promote the migration of scavengers into image layers by subjecting prints to localized high pressure (~5000 psi) and/or organic solvents.

Another limitation relates to the migration of scavenger into the dye-forming layers prior to photographic processing. In this case, the scavenger may compete for Dox with dye-forming coupler and cause less efficient dye formation, resulting in loss of desired density and/or contrast. In particular, dispersions of magenta dye-forming couplers derived from pyrazoletriazoles are susceptible to scavenger competition. Neutral flat fields that develop to a more green looking neutral at the slit edge of a coating illustrate this problem. The cutting knives may subject the coating to enough local stress to force the scavenger into the magenta dye forming layer, causing this layer to develop to a lower density on the edge of the coating.

Scavengers also interfere with the light stability of the image dyes either by direct reaction with the dye when exposed to light, or by reaction with other components such as UV dyes and chemical stabilizers that are coated with photographic couplers to protect the image dyes from exposure to light. Destruction of the UV dyes or stabilizers enhances the rate of fade of the image dye.

Scavengers also limit the inherent chemical efficiency of a photographic system because Dox is lost to reactions that produce no image dye. Raising the level of silver to compensate for the loss of Dox can lead to increased chemical cross talk and process sensitivity. More efficient conversion of Dox to image dye permits lower silver lay downs and shorter development times for a given density.

These problems have been described in detail in U.S. Pat. No. 5,736,303 which teaches the preferred ratio of gel to organic component in the coating layers to minimize scavenger migration. It would be more preferred, however, to substantially or completely eliminate the scavengers in the interlayers while retaining good color purity.

R. W. G. Hunt, *The Reproduction of Color in Photography, Printing and Television*, 4th Edition, Copyright 1987, Fountain Press, Chapter 8, Plate 10 describes the structure of conventional color paper and shows the interlayers separating the three dye forming image layers.

U.S. Pat. No. 5,744,287 teaches preferred dye characteristic curves for a conventional paper in a sub-50 microsecond exposure.

Lower contrast toe regions of the paper H&D curves can alleviate contouring. Kokai JP 05/142712-A of Kawai teaches the preferred toe shape of the characteristic dye curve in a scanning exposure employing 10 bit modulation.

U.S. Pat. No. 5,576,159 describes a photographic element having a color enhancing layer in between an emulsion layer and an oxidized developer scavenger layer U.S. Pat. No. 4,040,829 describes a photographic structure where a semi-diffusible coupler layer is coated on top of the topmost emulsion layer.

European Patent Application No. 0 062 202 describes a structure in which the emulsion layers are sandwiched between two coupler containing layers.

Japanese Kokai Patent Application No. Sho 53[1978]-65730 teaches using an additional 0.01–0.3 g/m$^2$ of yellow coupler in the interlayer between the blue light sensitive layer and the green light sensitive layer.

PROBLEM TO BE SOLVED BY THE INVENTION

There is a need for color print media that have improved keeping properties and better utilize exposed silver in image formation.

SUMMARY OF THE INVENTION

It is an object of the invention to overcome disadvantages of prior inventions.

It is a further object to provide a photographic element with good digital exposure.

It is another object to provide print material with efficient use of exposed silver.

These and other objects of the invention generally are accomplished by a multilayer photographic element comprising a reflective support wherein the color record 1 adjacent to the support comprises at least one light sensitive layer and a non-light sensitive dye-forming interlayer; and wherein color record 2 above said color record 1 comprises at least one light sensitive layer and at least two non-light sensitive dye-forming interlayers and wherein color record 3 comprises at least one light sensitive layer and a non-light sensitive dye-forming interlayer; an optional UV dye containing interlayer; and top overcoat; and wherein each interlayer is substantially scavenger free, comprises silver halide grains comprising greater than 90% silver chloride, and wherein the reciprocity characteristics of the silver halide grains are such that for a separation exposure of 1 microsecond and 0.4 sec, at least one color record develops to a density of at least 2.0 within a log exposure range of 1.2 or less relative to the exposure point producing a density 0.04 above Dmin.

ADVANTAGEOUS EFFECT OF THE INVENTION

The invention provides an improved member for digital exposure with efficient use of silver and good keeping properties.

BRIEF DESCRIPTION OF THE DRAWING

FIG. 1 illustrates the Dmax, Dmin, slope, and log exposure range of an example characteristic dye curve applicable to the current invention.

DETAILED DESCRIPTION OF THE INVENTION

Figure 7:
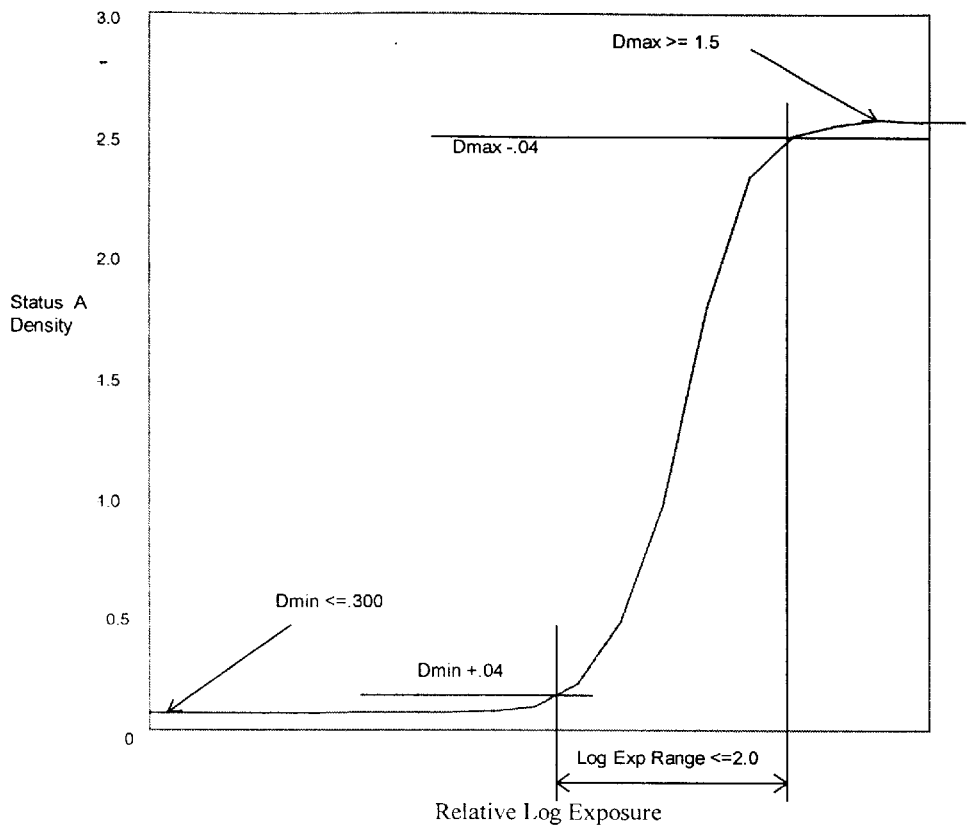

The invention has numerous advantages over prior materials. The invention provides a print member that has good photographic performance when digitally exposed such as by laser printers. The print material further provides efficient use of silver. The member, as it is substantially free of DOH, has improved keeping properties. The media member further provides efficient use of couplers as substantially all silver that is exposed results in color development. These and other advantages will be apparent from the detailed description below.

For the current invention, the term "overcoat" refers to the layer farthest from the support. The term "interlayer" refers to any layer other than the overcoat that does not contain silver halide. The term "color record" refers to the combination of layers in the multilayer structure that has a common dye-forming coupler. Thus, the "magenta color record" of the present invention comprises the layer containing a mixture of green light sensitive silver halide grains and magenta dye-forming coupler, plus the two surrounding interlayers containing magenta dye-forming coupler, as shown in Table 2. The "yellow color record" of the present invention comprises the layer containing blue light sensitive silver halide grains and yellow dye-forming coupler, plus the adjacent interlayer containing yellow dye-forming coupler. The "cyan color record" of the present invention comprises the layer containing a mixture of red light sensitive silver halide grains and cyan dye-forming coupler, plus the adjacent interlayer containing cyan dye-forming coupler. Substantially scavenger free means less than $3\times10^{-5}$ mol/m$^3$ of scavenger present.

The current invention does not restrict the particular layer order of each color record. Thus, the yellow dye forming color record may occupy color record positions 1, or 2, or 3 in the multilayer; the same may be said for the cyan and magenta dye forming color records.

The desired cyan, magenta, or yellow appearing dyes formed in the individual color records absorb the strongest in the red, green, and blue wavelength regions of the visible light spectrum respectively. Accordingly, the Status A reflection red, green, and blue densities of the desired cyan, magenta, and yellow dyes are designated the Major density components for these dyes respectively. Typically, each dye also absorbs to a lesser extent in the other two regions of the spectrum. The Status A reflection densities corresponding to the two lesser absorbed regions of the visible light spectrum are designated the Minor density components for each dye. In a multilayer, where it is possible for chemical cross talk to cause the formation of dye in two or more color records from a single separation exposure, the Minor density component comprises also the absorption by the unwanted dye as well. When chemical cross talk occurs, the Minor density component increases relative to the Major density component for a separation exposure.

The current invention combines a new multilayer structure and the characteristic dye curves in each color record that produce pleasing prints after exposure and development. Accordingly, the light sensitive layer of each color record in the current invention is comprised of gelatin, a dispersed dye-forming coupler, and silver halide grains comprising>90% silver chloride. The primary components of the non-light sensitive interlayers are dispersed dye-forming coupler, gelatin, and optionally up to $3.0\times10^{-5}$ mol/m$^2$ scavenger. The preferred multilayer structure has no scavenger in the interlayers. The overcoat may contain 0 to 0.020 g/m$^2$ scavenger.

On reflection support each color record of the invention multilayer structure produces after exposure and development a characteristic dye curve having the following properties at one or more exposure times in the range 20 nanoseconds to 500 seconds:

1. the maximum slope of the characteristic dye curve has a value ranging from 2.0 to 5.0;
2. the maximum Status A reflection density after separation exposure followed by development is>=1.0;
3. the minimum Status A reflection density after development is<=0.300 in each color record;
4. the log exposure range between the Dmin plateau plus+ 0.04 Status A density units and the Dmax plateau−0.04 Status A density units does not exceed 2.0.

It is preferred, but not necessary, that the shape of the characteristic dye curve as shown in FIG. 1 shows minimal change within the range of exposure times 20 nsec to 500 sec.

The current invention comprises a multilayer photographic structure having eight or more individual coated layers on a reflection support as illustrated in Table 2, wherein color record number 1 (adjacent to the support) comprises light sensitive layer 1 and non-light sensitive interlayer 2; wherein color record number 2 comprises light sensitive layer 4 and non-light sensitive interlayers 3 & 5; and wherein color record number 3 comprises light sensitive layer 7 and non-light sensitive interlayer 6; and wherein layer 8 comprises the overcoat; and wherein the total scavenger in each interlayer does not exceed $3.0\times10^{-5}$ mol/m$^2$ Dox scavenger. The preferred level of scavenger is zero.

It is a limitation of the current invention that the total silver laydown on a reflection support does not exceed 1.076 $g/m^2$ (100 $mg/ft^2$). The preferred level is<=0.70 $g/m^2$ (65 $mg/ft^2$), and the most preferred level is<=0.59 $g/m^2$ (55 $mg/ft^2$).

It is an additional limitation of the current invention that the total gelatin laydown on a reflection support does not exceed 10.76 $g/m^2$ (1000 $mg/ft^2$). The preferred level is<= 8.07 $g/m^2$ (750 $mg/ft^2$), and the most preferred level is<=7.0 $g/m^2$ (650 $mg/ft^2$).

It is a further limitation of the current invention that for each color record, a 0.4 sec separation exposure followed by development produces a dye having Status A reflection Minor density components not exceeding the values specified in Table 1A for a Status A reflection Major density component equal to 2.0.

It is a further limitation of the current invention that for each color record, a 1 microsecond separation exposure followed by development produces a dye having Status A reflection Minor density components not exceeding the values specified in Table 2A for a Status A reflection Major density component equal to 1.8 in the cyan color record, 1.6 in the magenta color record, and 1.4 in the yellow color record.

The current invention comprises in a preferred form

1) A multilayer photographic structure as illustrated in Table 1, wherein color record number 1 (adjacent to the support) comprises light sensitive layer 1 and non-light sensitive dye-forming interlayer 2; and wherein color record number 2 comprises light sensitive layer 4 and non-light sensitive dye-forming interlayers 3 & 5; and wherein color record number 3 comprises light sensitive layer 7 and non-light sensitive dye-forming interlayer 6; and wherein layer 8 comprises the overcoat; and wherein the total scavenger in each interlayer does not exceed $3.0\times 10^{-5}$ $mol/m^2$. The preferred level of scavenger is zero.
2) The silver halide grains are>90% silver chloride.
3) The reciprocity characteristics of the silver halide grains are such that for a separation exposure of 1 microsecond and 0.4 sec, each color record develops to a density of at least 2.0 within a log exposure range of 1.2 or less relative to the exposure point producing a density 0.04 above Dmin.
4) The total silver laydown on reflection support does not exceed 0.7 $g/m^2$ and the preferred level is less than 0.60 $g/m^2$.
5) The magenta couplers are pyrazoletriazoles.
6) The interlayers contain no silver halide.
7) The combined total gelatin laydown on reflection support does not exceed 8.1 $g/m^2$ and the preferred level is less than 7.5 $g/m^2$.

The invention provides interlayers adjacent each color record that comprises a coupler that forms the same color as within the color record layer but is free of silver halide. This interlayer serves to develop color as Dox from developing of the silver leaves the color record layer and enters the interlayer. Prior products utilize scavengers in the interlayer such as DOH that perform the function of reacting with Dox before it could develop coupler in another layer and thereby contaminate the color reproduction of the element. DOH had the disadvantage that it tended to yellow the photographic element upon aging as well as, in effect, wasting Dox, as it was not utilized to develop color. The instant invention as illustrated in Table 2 is able to get maximum performance from developed silver. The performance allows each color record to develop to a density of at least 2.0 within a log exposure range of 1.2 or less relative to the exposure point producing a density of 0.04 above Dmin. This is exceptional performance, particularly for short exposures utilized in digital exposure. The interlayers are substantially silver halide free and preferably have no silver halide.

The optical performance of the photographic elements of the invention remains exceptional with optical exposure resulting in bright, sharp prints. It is a feature of this invention that prints made either optically or by digital exposure have substantially the same excellent characteristics. The element of the invention also exhibits exceptional resistance to degradation in image quality caused by exposure to sunlight or other sources of ultraviolet radiation. These and other advantages will be apparent from the detailed description below.

A full color photographic imaging element has at least one layer comprising a cyan dye forming coupler, one layer comprising a magenta dye forming coupler, and one layer comprising a yellow dye forming coupler and produces when developed an image in full color. Imaging layers are layers that contain sensitized silver halide and dye forming coupler.

The terms as used herein, "top", "upper", "emulsion side", "imaging side" and "face" mean the side or towards the side of an imaging member bearing the imaging layers or developed image. The terms "bottom", "lower side", and "back" mean the side or towards the side of the imaging member opposite from the side bearing the imaging layers or developed image. The term substrate as used herein refers to a support or base material that is the primary part of an imaging element such as paper, polyester, vinyl, synthetic paper, fabric, or other suitable material for the viewing of images. As used herein, the phrase "photographic element" is a material that utilizes photosensitive silver halide in the formation of images. The photographic elements are full color elements. Full color elements contain image dye-forming units sensitive to each of the three primary regions of the spectrum. Each unit can comprise a single emulsion layer or multiple emulsion layers sensitive to a given region of the spectrum. The layers of the element, including the layers of the image-forming units, can be arranged in various orders as known in the art.

The photographic emulsions useful for this invention are generally prepared by precipitating silver halide crystals in a colloidal matrix by methods conventional in the art. The colloid is typically a hydrophilic film-forming agent such as gelatin, alginic acid, or derivatives thereof.

The invention structure that does not use scavengers in the interlayers has been found to result in bright images with rapid development at a combined gelatin laydown on the reflection support does not exceed 8.1 $g/m^2$. It has been found that preferably the gelatin laydown is less than 7.5 $g/m^2$ and greater than 4.3 $g/m^2$ (400 $mg/ft^2$) in order to achieve a rapid developing photographic image with clear, sharp images.

The crystals formed in the precipitation step are washed and then chemically and spectrally sensitized by adding spectral sensitizing dyes and chemical sensitizers, and by providing a heating step during which the emulsion temperature is raised, typically from 40° C. to 70° C., and maintained for a period of time. The precipitation and spectral and chemical sensitization methods utilized in preparing the emulsions employed in the invention can be those methods known in the art.

The reflective support of the present invention preferably includes a resin layer with a stabilizing amount of hindered amine extruded on the top side of the imaging layer substrate. Hindered amine light stabilizers (HALS) originate from 2,2,6,6-tertramethylpiperidine. The hindered amine should be added to the polymer layer at about 0.01–5% by weight of said resin layer in order to provide resistance to polymer degradation upon exposure to UV light. The preferred amount is at about 0.05–3% by weight. This provides excellent polymer stability and resistance to cracking and yellowing while keeping the expense of the hindered amine to a minimum. Examples of suitable hindered amines with molecular weights of less than 2300 are Bis(2,2,6,6-letramethyl-4-piperidinyl)sebacate; Bis(1,2,2,6,6-pentamethyl-4-piperidinyl)sebacate; Bis(1,2,2,6,6-pentamethyl-4-piperidinyl)2-n-butyl-(3,5-di-tert-butyl-hydroxy-benzyl)malonate; 8-Acetly-3-dodecyl-7,7,9,9-tetramethly-1.3,8-triazaspirol(4,5)decane-2,4-dione; Tetra(2,2,6,6-tetramethyl-4-piperidinyl)1,2,3,4-butanetetracarboxylate; 1-(-2-[3,5-di-tert-butyl-4-hydroxyphenyl-propionyloxyl]ethyl)-4-(3,5-di-tert-butyl-4-hydroxyphenylpropionyloxy)-2,2,6,6-tetramethylpiperidine; 1,1'-(1,2-ethenadiyl)bis(3,3,5,5-tetramethyl-2-piperazinone); The preferred hindered amine is 1,3,5-triazine-2,4,6-triamine,N,N'''-[1,2-ethanediylbis[[[4,6-bis(butyl(1,2,2,6,6-pentamethyl-4-piperidinyl)amino]-1,3,5-triazine-2-yl]imino]-3,1 propanediyl]]-bis[N',N''-dibutyl-N',N''-bis(1,2,2,6,6-pentamethyl-4-piperidinyl) which will be referred to as Compound A. Compound A is preferred because when mixtures of polymers and Compound A are extruded onto imaging paper the polymer to paper adhesion is excellent and the long term stability of the imaging system against cracking and yellowing is improved.

Suitable polymers for the resin layer include polyethylene, polypropylene, polymethylpentene, polystyrene, polybutylene, and mixtures thereof. Polyolefin copolymers, including copolymers of polyethylene, propylene and ethylene such as hexene, butene, and octene are also useful. Polyethylene is most preferred, as it is low in cost and has desirable coating properties. As polyethylene, usable are high-density polyethylene, low-density polyethylene, linear low density polyethylene, and polyethylene blends. Other suitable polymers include polyesters produced from aromatic, aliphatic or cycloaliphatic dicarboxylic acids of 4–20 carbon atoms and aliphatic or alicyclic glycols having from 2–24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexanedicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Other polymers are matrix polyesters having repeat units from terephthalic acid or naphthalene dicarboxylic acid and at least one glycol selected from ethylene glycol, 1,4-butanediol and 1,4-cyclohexanedimethanol such as poly(ethylene terephthalate), which may be modified by small amounts of other monomers. Other suitable polyesters include liquid crystal copolyesters formed by the inclusion of suitable amount of a co-acid component such as stilbene dicarboxylic acid. Examples of such liquid crystal copolyesters are those disclosed in U.S. Pat. Nos. 4,420,607; 4,459,402; and 4,468,510. Useful polyamides include nylon 6, nylon 66, and mixtures thereof. Copolymers of polyamides are also suitable continuous phase polymers. An example of a useful polycarbonate is bisphenol-A polycarbonate. Cellulosic esters suitable for use as the continuous phase polymer of the composite sheets include cellulose nitrate, cellulose triacetate, cellulose diacetate, cellulose acetate propionate, cellulose acetate butyrate, and mixtures or copolymers thereof. Useful polyvinyl resins include polyvinyl chloride, poly(vinyl acetal), and mixtures thereof. Copolymers of vinyl resins can also be utilized.

Any suitable white pigment may be incorporated in the polyolefin layer, such as, for example, zinc oxide, zinc sulfide, zirconium dioxide, white lead, lead sulfate, lead chloride, lead aluminate, lead phthalate, antimony trioxide, white bismuth, tin oxide, white manganese, white tungsten, and combinations thereof. The preferred pigment is titanium dioxide because of its high refractive index, which gives excellent optical properties at a reasonable cost. The pigment is used in any form that is conveniently dispersed within the polyolefin. The preferred pigment is anatase titanium dioxide. The most preferred pigment is rutile titanium dioxide because it has the highest refractive index at the lowest cost. The average pigment diameter of the rutile $TiO_2$ is most preferably in the range of 0.1 to 0.26 $\mu$m. The pigments that are greater than 0.26 $\mu$m are too yellow for an imaging element application and the pigments that are less than 0.1 $\mu$m are not sufficiently opaque when dispersed in polymers. Preferably, the white pigment should be employed in the range of from about 10 to about 50 percent by weight, based on the total weight of the polyolefin coating. Below 10 percent $TiO_2$, the imaging system will not be sufficiently opaque and will have inferior optical properties. Above 50 percent $TiO_2$, the polymer blend is not manufacturable. The surface of the $TiO_2$ can be treated with an inorganic compounds such as aluminum hydroxide, alumina with a fluoride compound or fluoride ions, silica with a fluoride compound or fluoride ion, silicon hydroxide, silicon dioxide, boron oxide, boria-modified silica (as described in U.S. Pat. No. 4,781,761), phosphates, zinc oxide, $ZrO_2$, etc. and with organic treatments such as polyhydric alcohol, polyhydric amine, metal soap, alkyl titanate, polysiloxanes, silanes, etc. The organic and inorganic $TiO_2$ treatments can be used alone or in any combination. The amount of the surface treating agents is preferably in the range of 0.2 to 2.0% for the inorganic treatment and 0.1 to 1% for the organic treatment, relative to the weight of the weight of the titanium dioxide. At these levels of treatment the $TiO_2$ disperses well in the polymer and does not interfere with the manufacture of the imaging support.

The polymer, hindered amine light stabilizer, and the $TiO_2$ are mixed with each other in the presence of a dispersing agent. Examples of dispersing agents are metal salts of higher fatty acids such as sodium palmitate, sodium stearate, calcium palmitate, sodium laurate, calcium stearate, aluminum stearate, magnesium stearate, zirconium octylate, zinc stearate, etc, higher fatty acids, higher fatty amide, and higher fatty acids. The preferred dispersing agent is sodium stearate and the most preferred dispersing agent is zinc stearate. Both of these dispersing agents give superior whiteness to the resin-coated layer.

For photographic use, a white base with a slight bluish tint is preferred. The layers of the waterproof resin coating preferably contain colorants such as a bluing agent and magenta or red pigment. Applicable bluing agents include commonly know ultramarine blue, cobalt blue, oxide cobalt phosphate, quinacridone pigments, and a mixture thereof. Applicable red or magenta colorants are quinacridones and ultramarines.

The resin may also include a fluorescing agent, which absorb energy in the UV region and emit light largely in the blue region. Any of the optical brighteners referred to in U.S. Pat. No. 3,260,715 or a combination thereof would be beneficial.

The resin may also contain an antioxidant(s) such as hindered phenol primary antioxidants used alone or in combination with secondary antioxidants. Examples of hindered phenol primary antioxidants include pentaerythrityl tetrakis [3-(3,5-di-tert-butyl-4-hydroxyphenyl)proprionate] (such as Irganox 1010), octadecyl 3-(3,5-di-tert-butyl-4-hydroxyphenyl)proprionate (such as Irganox 1076 which will be referred to as compound B), benzenepropanoic acid 3,5-bis(1,1-dimethyl)-4-hydroxy-2[3-[3,5-bis(1,1-dimethylethyl)-4-hydroxyphenyl)-1-oxopropyl)hydrazide (such as Irganox MD 1024), 2,2'-thiodiethylenebis[3-(3,5-di-tert-butyl-4-hydroxyphenyl)proprionate] (such as Irganox 1035), 1,3,5-trimethyl-2,4,6-tri( 3,5-di-tert-butyl-4-hydroxybenzyl)benzene (such as Irganox 1330), but are not limited to these examples. Secondary antioxidants include organic alkyl and aryl phosphites including examples such as triphenylphosphite (such as Irgastab TPP), tri(n-propylphenyl-phophite) (such as Irgastab SN-55), 2,4-bis(1,1-dimethylphenyl) phosphite (such as Irgafos 168).

The hindered amine light stabilizer, $TiO_2$, colorants, slip agents, optical brightener, and antioxidant are incorporated either together or separately with the polymer using a continuous or Banburry mixer. A concentrate of the additives in the form of a pellet is typically made. The concentration of the rutile pigment can be from 20% to 80% by weight of the master batch. The master batch is then adequately diluted for use with the resin.

The support to which the waterproof resin layer is laminated may be a polymeric, a synthetic paper, cloth, woven polymer fibers, or a cellulose fiber paper support, or laminates thereof. The base also may be a microvoided polyethylene terephalate such as disclosed in U.S. Pat. Nos. 4,912,333; 4,994,312; and 5,055,371. The preferred support is a photographic grade cellulose fiber paper.

To form the waterproof resin coating according to the present invention, the pellet containing the pigment and other additives is subjected to hot-melt coating onto a running support of paper or synthetic paper. If desired, the pellet is diluted with a polymer prior to hot melt coating. For a single layer coating the resin layer may be formed by lamination. The die is not limited to any specific type and may be any one of the common dies such as a T-slot or coat hanger die. An exit orifice temperature in heat melt extrusion of the waterproof resin ranges from 500–660° F. Further, before coating the support with resin, the support may be treated with an activating treatment such as corona discharge, flame, ozone, plasma, or glow discharge.

The thickness of the resin layer which is applied to a base paper of the reflective support used in the present invention at a side for imaging, is preferably in the range of 5 to 100 $\mu$m and most preferably in the range of 10 to 50 $\mu$m.

The thickness of the resin layer applied to a base paper on the side opposite the imaging element is preferably in a range from 5 to 100 $\mu$m and more preferably from 10 to 50 $\mu$m.

The surface of the waterproof resin coating at the imaging side may be a glossy, fine, silk, grain, or matte surface. On the surface of the waterproof coating on the backside which is not coated with an imaging element may also be glossy, fine, silk, or matte surface. The preferred water-proof surface for the backside away from the imaging element is matte.

While described above as utilizing a photographic base of paper having polyethylene layers applied thereto for waterproofing and as to serve as a base for the color forming layers, the invention also may utilize photographic laminated base that has biaxially oriented polyolefin sheets laminated to each side of a base. In a preferred form this base uses biaxially oriented polypropylene sheets on each side of a paper sheet with a polyethylene surface layer on one sheet which aids in binding of the gelatin layers to the base. Such a base is described at U.S. Pat. Nos. 5,866,282; 5,888,643; and 5,888,683. These materials have the advantage that they allow sharper images and a brighter, more glossy finish on a base that is tougher and more tear resistant.

This invention is directed to a silver halide photographic element capable of excellent performance when exposed by either an electronic printing method or a conventional optical printing method. An electronic printing method comprises subjecting a radiation sensitive silver halide emulsion layer of a recording element to actinic radiation of at least $10^{-4}$ ergs/cm$^2$ for up to 100$\mu$ seconds duration in a pixel-by-pixel mode wherein the silver halide emulsion layer is comprised of silver halide grains as described above. A conventional optical printing method comprises subjecting a radiation sensitive silver halide emulsion layer of a recording element to actinic radiation of at least $10^{-4}$ ergs/cm$^2$ for $10^{-3}$ to 300 seconds in an imagewise mode wherein the silver halide emulsion layer is comprised of silver halide grains as described above.

This invention in a preferred embodiment utilizes a radiation-sensitive emulsion comprised of silver halide grains (a) containing greater than 50 mole percent chloride, based on silver, (b) having greater than 50 percent of their surface area provided by {100} crystal faces, and (c) having a central portion accounting for from 95 to 99 percent of total silver and containing two dopants selected to satisfy each of the following class requirements: (i) a hexacoordination metal complex which satisfies the formula $$[ML_6]^n \quad \text{(I)}$$

wherein n is zero, −1, −2, −3 or −4; M is a filled frontier orbital polyvalent metal ion, other than iridium; and $L_6$ represents bridging ligands which can be independently selected, provided that least four of the ligands are anionic ligands, and at least one of the ligands is a cyano ligand or a ligand more electronegative than a cyano ligand; and (ii) an iridium coordination complex containing a thiazole or substituted thiazole ligand.

This invention is directed towards a photographic recording element comprising a support and at least three light sensitive silver halide emulsion layers comprising silver halide grains as described above.

It has been discovered quite surprisingly that the combination of dopants (i) and (ii) provides greater reduction in reciprocity law failure than can be achieved with either dopant alone. Further, unexpectedly, the combination of dopants (i) and (ii) achieve reductions in reciprocity law failure beyond the simple additive sum achieved when employing either dopant class by itself. It has not been reported or suggested prior to this invention that the combination of dopants (i) and (ii) provides greater reduction in reciprocity law failure, particularly for high intensity and short duration exposures. The combination of dopants (i) and (ii) further unexpectedly achieves high intensity reciprocity with iridium at relatively low levels, and both high and low intensity reciprocity improvements even while using conventional gelatino-peptizer (e.g., other than low methionine gelatino-peptizer).

In a preferred practical application, the advantages can be transformed into increased throughput of digital substantially artifact-free color print images while exposing each pixel sequentially in synchronism with the digital data from an image processor.

In a preferred embodiment, the present invention is used in electronic printing method. Specifically, this embodiment is directed to an electronic printing method which comprises subjecting a radiation sensitive silver halide emulsion layer of a recording element to actinic radiation of at least $10^{-4}$ ergs/cm$^2$ for up to 100$\mu$ seconds duration in a pixel-by-pixel mode. The present invention realizes an improvement in reciprocity failure by selection of the radiation sensitive silver halide emulsion layer. While certain embodiments of the invention are specifically directed towards electronic printing, use of the emulsions and elements of the invention is not limited to such specific embodiment, and it is specifically contemplated that the emulsions and elements of the invention are also well suited for conventional optical printing.

It has been unexpectedly discovered that significantly improved reciprocity performance can be obtained for silver halide grains (a) containing greater than 50 mole percent chloride, based on silver, and (b) having greater than 50 percent of their surface area provided by {100} crystal faces by employing a hexacoordination complex dopant of class (i) in combination with an iridium complex dopant comprising a thiazole or substituted thiazole ligand. The reciprocity improvement is obtained for silver halide grains employing conventional gelatino-peptizer, unlike the contrast improvement described for the combination of dopants set forth in U.S. Pat. Nos. 5,783,373 and 5,783,378, which requires the use of low methionine gelatino-peptizers as discussed therein, and which states it is preferable to limit the concentration of any gelatino-peptizer with a methionine level of greater than 30 micromoles per gram to a concentration of less than 1 percent of the total peptizer employed. Accordingly, in specific embodiments of the invention, it is specifically contemplated to use significant levels (i.e., greater than 1 weight percent of total peptizer) of conventional gelatin (e.g., gelatin having at least 30 micromoles of methionine per gram) as a gelatino-peptizer for the silver halide grains of the emulsions of the invention. In preferred embodiments of the invention, gelatino-peptizer is employed which comprises at least 50 weight percent of gelatin containing at least 30 micromoles of methionine per gram, as it is frequently desirable to limit the level of oxidized low methionine gelatin which may be used for cost and certain performance reasons.

In a specific, preferred form of the invention it is contemplated to employ a class (i) hexacoordination complex dopant satisfying the formula:

$$[ML_6]^n \quad (I)$$

where n is zero, −1, −2, −3 or −4;

M is a filled frontier orbital polyvalent metal ion, other than iridium, preferably $Fe^{+2}$, $Ru^{+2}$, $Os^{+2}$, $Co^{+3}$, $Rh^{+3}$, $Pd^{+4}$ or $Pt^{+4}$, more preferably an iron, ruthenium or osmium ion, and most preferably a ruthenium ion;

$L_6$ represents six bridging ligands which can be independently selected, provided that least four of the ligands are anionic ligands and at least one (preferably at least 3 and optimally at least 4) of the ligands is a cyano ligand or a ligand more electronegative than a cyano ligand. Any remaining ligands can be selected from among various other bridging ligands, including aquo ligands, halide ligands (specifically, fluoride, chloride, bromide and iodide), cyanate ligands, thiocyanate ligands, selenocyanate ligands, tellurocyanate ligands, and azide ligands. Hexacoordinated transition metal complexes of class (i) which include six cyano ligands are specifically preferred.

Illustrations of specifically contemplated class (i) hexacoordination complexes for inclusion in the high chloride grains are provided by Olm et al U.S. Pat. No. 5,503,970 and Daubendiek et al U.S. Pat. Nos. 5,494,789 and 5,503,971, and Keevert et al U.S. Pat. No. 4,945,035, as well as Murakami et al Japanese Patent Application Hei-2[1990]-249588, and *Research Disclosure* Item 36736. Useful neutral and anionic organic ligands for class (ii) dopant hexacoordination complexes are disclosed by Olm et al U.S. Pat. No. 5,360,712 and Kuromoto et al U.S. Pat. No. 5,462,849.

Class (i) dopant is preferably introduced into the high chloride grains after at least 50 (most preferably 75 and optimally 80) percent of the silver has been precipitated, but before precipitation of the central portion of the grains has been completed. Preferably class (i) dopant is introduced before 98 (most preferably 95 and optimally 90) percent of the silver has been precipitated. Stated in terms of the fully precipitated grain structure, class (i) dopant is preferably present in an interior shell region that surrounds at least 50 (most preferably 75 and optimally 80) percent of the silver and, with the more centrally located silver, accounts the entire central portion (99 percent of the silver), most preferably accounts for 95 percent, and optimally accounts for 90 percent of the silver halide forming the high chloride grains. The class (i) dopant can be distributed throughout the interior shell region delimited above or can be added as one or more bands within the interior shell region.

Class (i) dopant can be employed in any conventional useful concentration. A preferred concentration range is from $10^{-8}$ to $10^{-3}$ mole per silver mole, most preferably from $10^{-6}$ to $5\times10^{-4}$ mole per silver mole.

The following are specific illustrations of class (i) dopants:

(i-1)$[Fe(CN)_6]^{-4}$
(i-2)$[Ru(CN)_6]^{-4}$
(i-3)$[Os(CN)_6]^{-4}$
(i-4)$[Rh(CN)_6]^{-3}$
(i-5)$[Co(CN)_6]^{-3}$
(i-6)$[Fe(pyrazine)(CN)_5]^{-4}$
(i-7)$[RuCl(CN)_5]^{-4}$
(i-8)$[OsBr(CN)_3]^{-4}$
(i-9)$[RhF(CN)_5]^{-3}$
(i-10)$[In(NCS)_6]^{-3}$
(i-11)$[FeCO(CN)_5]^{-3}$
(i-12)$[RuF_2(CN)_4]^{-4}$
(i-13)$[OsCl_2(CN)_4]^{-4}$
(i-14)$[RhI_2(CN)_4]^{-3}$
(i-15)$[Ga(NCS)_6]^{-3}$
(i-16)$[Ru(CN)_5(OCN)]^{-4}$
(i-17)$[Ru(CN)_5(N_3)]^{-4}$
(i-18)$[Os(CN)_5(SCN)]^{-4}$
(i-19)$[Rh(CN)_5(SeCN)]^{-3}$
(i-20)$[Os(CN)Cl_5]^{-4}$
(i-21)$[Fe(CN)_3Cl_3]^{-3}$
(i-22)$[Ru(CO)_2(CN)_4]^{-1}$ When the class (i) dopants have a net negative charge, it is appreciated that they are associated with a counter ion when added to the reaction vessel during precipitation. The counter ion is of little importance, since it is ionically dissociated from the dopant in solution and is not incorporated within the grain. Common counter ions known to be fully compatible with silver chloride precipitation, such as ammonium and alkali metal ions, are contemplated. It is noted that the same comments apply to class (ii) dopants, otherwise described below.

The class (ii) dopant is an iridium coordination complex containing at least one thiazole or substituted thiazole ligand. Careful scientific investigations have revealed Group VIII hexahalo coordination complexes to create deep electron traps, as illustrated R. S. Eachus, R. E. Graves and M. T. Olm *J. Chem. Phys.*, Vol. 69, pp. 4580–7 (1978) and *Physica Status Solidi A*, Vol. 57, 429–37 (1980) and R. S. Eachus and M. T. Olm *Annu. Rep. Prog. Chem. Sect. C. Phys. Chem.*, Vol. 83, 3, pp. 3–48 (1986). The class (ii) dopants employed in the practice of this invention are believed to create such deep electron traps. The thiazole ligands may be substituted with any photographically acceptable substituent which does not prevent incorporation of the dopant into the silver halide grain. Exemplary substituents include lower alkyl (e.g., alkyl groups containing 1–4 carbon atoms), and specifically methyl. A specific example of a substituted thiazole ligand which may be used in accordance with the invention is 5-methylthiazole. The class (ii) dopant preferably is an iridium coordination complex having ligands each of which are more electropositive than a cyano ligand. In a specifically preferred form the remaining non-thiazole or non-substituted-thiazole ligands of the coordination complexes forming class (ii) dopants are halide ligands.

It is specifically contemplated to select class (ii) dopants from among the coordination complexes containing organic ligands disclosed by Olm et al U.S. Pat. No. 5,360,712; Olm et al U.S. Pat. No. 5,457,021; and Kuromoto et al U.S. Pat. No. 5,462,849.

In a preferred form it is contemplated to employ as a class (ii) dopant a hexacoordination complex satisfying the formula:

$$[IrL^1_6]^{n'} \quad \text{(II)}$$

wherein n' is zero, −1, −2, −3 or −4; and $L^1_6$ represents six bridging ligands which can be independently selected, provided that at least four of the ligands are anionic ligands, each of the ligands is more electropositive than a cyano ligand, and at least one of the ligands comprises a thiazole or substituted thiazole ligand. In a specifically preferred form at least four of the ligands are halide ligands, such as chloride or bromide ligands.

Class (ii) dopant is preferably introduced into the high chloride grains after at least 50 (most preferably 85 and optimally 90) percent of the silver has been precipitated, but before precipitation of the central portion of the grains has been completed. Preferably class (ii) dopant is introduced before 99 (most preferably 97 and optimally 95) percent of the silver has been precipitated. Stated in terms of the fully precipitated grain structure, class (ii) dopant is preferably present in an interior shell region that surrounds at least 50 (most preferably 85 and optimally 90) percent of the silver and, with the more centrally located silver, accounts the entire central portion (99 percent of the silver), most preferably accounts for 97 percent, and optimally accounts for 95 percent of the silver halide forming the high chloride grains. The class (ii) dopant can be distributed throughout the interior shell region delimited above or can be added as one or more bands within the interior shell region.

Class (ii) dopant can be employed in any conventional useful concentration. A preferred concentration range is from $10^{-9}$ to $10^{-4}$ mole per silver mole. Iridium is most preferably employed in a concentration range of from $10^{-8}$ to $10^{-5}$ mole per silver mole.

Specific illustrations of class (ii) dopants are the following:

(ii-1)$[IrCl_5(\text{thiazole})]^{-2}$
(ii-2)$[IrCl_4(\text{thiazole})_2]^{-1}$
(ii-3)$[IrBr_5(\text{thiazole})]^{-2}$
(ii-4)$[IrBr_4(\text{thiazole})_2]^{-1}$
(ii-5)$[IrCl_5(\text{5-methylthiazole})]^{-2}$
(ii-6)$[IrCl_4(\text{5-methylthiazole})_2]^{-1}$
(ii-7)$[IrBr_5(\text{5-methylthiazole})]^{-2}$
(ii-8)$[IrBr_4(\text{5-methylthiazole})_2]^{-1}$ In one preferred aspect of the invention in a layer using a magenta dye forming coupler, a class (ii) dopant in combination with an $OsCl_5(NO)$ dopant has been found to produce a preferred result.

Emulsions demonstrating the advantages of the invention can be realized by modifying the precipitation of conventional high chloride silver halide grains having predominantly (>50%) {100} crystal faces by employing a combination of class (i) and (ii) dopants as described above.

The silver halide grains precipitated contain greater than 50 mole percent chloride, based on silver. Preferably the grains contain at least 70 mole percent chloride and, optimally at least 90 mole percent chloride, based on silver. Iodide can be present in the grains up to its solubility limit, which is in silver iodochloride grains, under typical conditions of precipitation, about 11 mole percent, based on silver. It is preferred for most photographic applications to limit iodide to less than 5 mole percent iodide, most preferably less than 2 mole percent iodide, based on silver.

Silver bromide and silver chloride are miscible in all proportions. Hence, any portion, up to 50 mole percent, of the total halide not accounted for chloride and iodide, can be bromide. For color reflection print (i.e., color paper) uses bromide is typically limited to less than 10 mole percent based on silver and iodide is limited to less than 1 mole percent based on silver.

In a widely used form high chloride grains are precipitated to form cubic grains—that is, grains having {100} major faces and edges of equal length. In practice ripening effects usually round the edges and corners of the grains to some extent. However, except under extreme ripening conditions substantially more than 50 percent of total grain surface area is accounted for by {100} crystal faces.

High chloride tetradecahedral grains are a common variant of cubic grains. These grains contain 6 {100} crystal faces and 8 {111 } crystal faces. Tetradecahedral grains are within the contemplation of this invention to the extent that greater than 50 percent of total surface area is accounted for by {100} crystal faces.

Although it is common practice to avoid or minimize the incorporation of iodide into high chloride grains employed in color paper, it is has been recently observed that silver iodochloride grains with {100} crystal faces and, in some instances, one or more {111} faces offer exceptional levels of photographic speed. In the these emulsions iodide is incorporated in overall concentrations of from 0.05 to 3.0 mole percent, based on silver, with the grains having a surface shell of greater than 50 Å that is substantially free of iodide and a interior shell having a maximum iodide concentration that surrounds a core accounting for at least 50 percent of total silver. Such grain structures are illustrated by Chen et al EPO 0 718 679.

In another improved form the high chloride grains can take the form of tabular grains having {100} major faces. Preferred high chloride {100} tabular grain emulsions are those in which the tabular grains account for at least 70 (most preferably at least 90) percent of total grain projected area. Preferred high chloride {100} tabular grain emulsions have average aspect ratios of at least 5 (most preferably at least>8). Tabular grains typically have thicknesses of less than 0.3 μm, preferably less than 0.2 μm, and optimally less than 0.07 μm. High chloride {100} tabular grain emulsions and their preparation are disclosed by Maskasky U.S. Pat. Nos. 5,264,337 and 5,292,632; House et al U.S. Pat. No. 5,320,938; Brust et al U.S. Pat. No. 5,314,798; and Chang et al U.S. Pat. No. 5,413,904.

Once high chloride grains having predominantly {100} crystal faces have been precipitated with a combination of class (i) and class (ii) dopants described above, chemical and spectral sensitization, followed by the addition of conventional addenda to adapt the emulsion for the imaging application of choice can take any convenient conventional form. These conventional features are illustrated by *Research Disclosure*, Item 38957, cited above, particularly:

III. Emulsion washing;

IV. Chemical sensitization;

V. Spectral sensitization and desensitization;

VII. Antifoggants and stabilizers;

VIII. Absorbing and scattering materials;

IX. Coating and physical property modifying addenda; and

X. Dye image formers and modifiers.

Some additional silver halide, typically less than 1 percent, based on total silver, can be introduced to facilitate chemical sensitization. It is also recognized that silver halide can be epitaxially deposited at selected sites on a host grain to increase its sensitivity. For example, high chloride {100} tabular grains with comer epitaxy are illustrated by Maskasky U.S. Pat. No. 5,275,930. For the purpose of providing a clear demarcation, the term "silver halide grain" is herein employed to include the silver necessary to form the grain up to the point that the final {100} crystal faces of the grain are formed. Silver halide later deposited that does not overlie the {100} crystal faces previously formed accounting for at least 50 percent of the grain surface area is excluded in determining total silver forming the silver halide grains. Thus, the silver forming selected site epitaxy is not part of the silver halide grains while silver halide that deposits and provides the final {100} crystal faces of the grains is included in the total silver forming the grains, even when it differs significantly in composition from the previously precipitated silver halide.

The emulsions can be spectrally sensitized with any of the dyes known to the photographic art, such as the polymethine dye class, which includes the cyanines, merocyanines, complex cyanines and merocyanines, oxonols, hemioxonols, styryls, merostyryls and streptocyanines. In particular, it would be advantageous to select from among the low staining sensitizing dyes disclosed in U.S. Pat. Nos. 5,292,634; 5,316,904; 5,418,126 and 5,492,802. Use of low staining sensitizing dyes in a photographic element processed in a developer solution with little or no optical brightening agent (for instance, stilbene compounds such as Blankophor REU™) is specifically contemplated. Further, these low staining dyes can be used in combination with other dyes known to the art (*Research Disclosure*, September 1996, Item 38957, Section V).

Useful sensitizing dyes include, but are not limited to, the following.

BSD-1

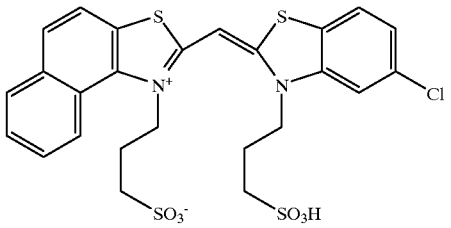

BSD-2

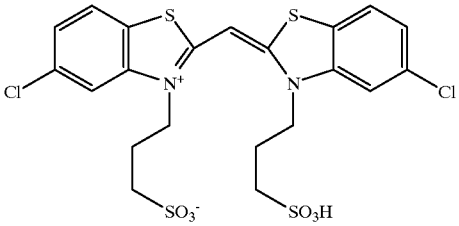

BSD-3

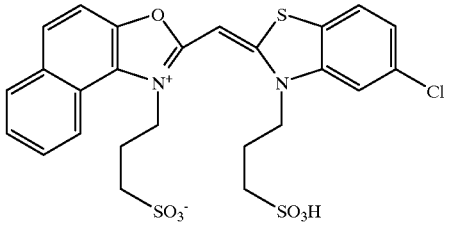

BSD-4

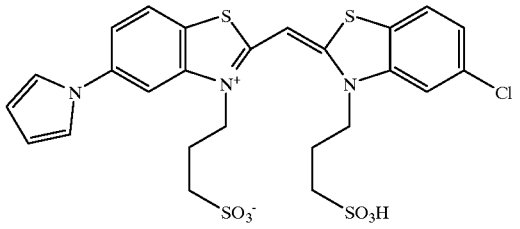

GSD-1

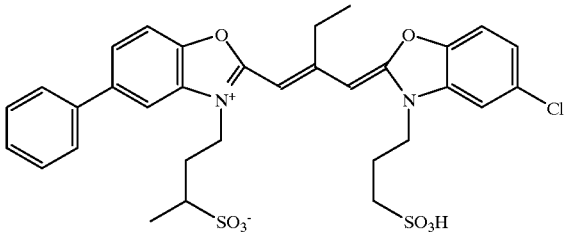

GSD-2

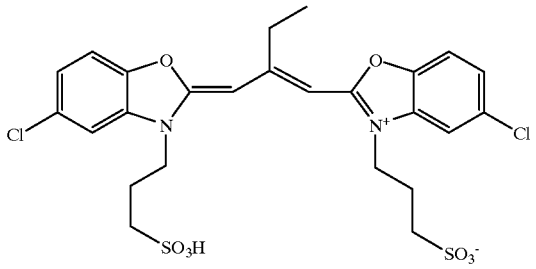

-continued

GSD-3

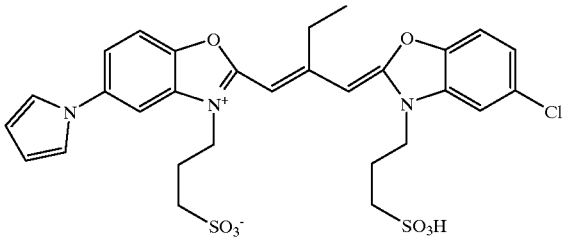

GSD-4

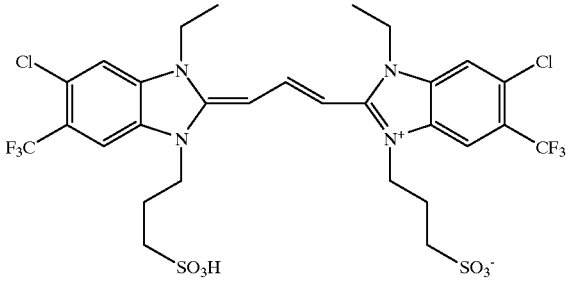

RSD-1

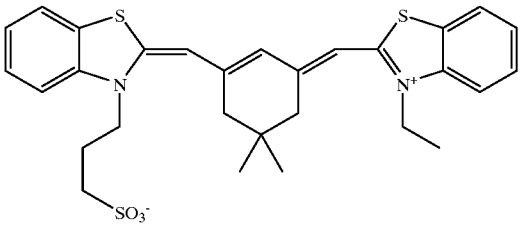

RSD-2

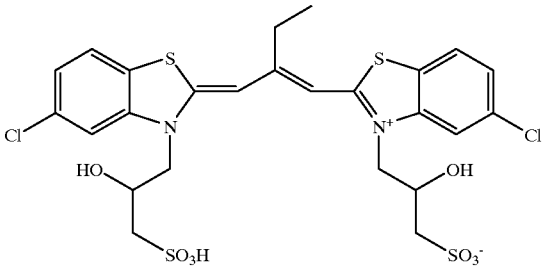

RSD-3

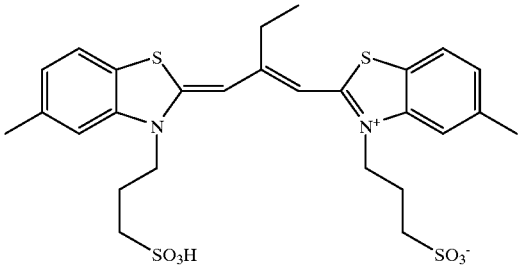

-continued

RSD-4

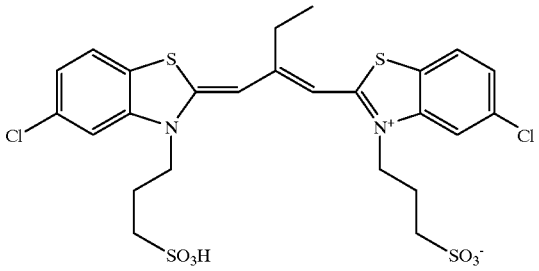

Emulsions can be spectrally sensitized with mixtures of two or more sensitizing dyes which form mixed dye aggregates on the surface of the emulsion grain. The use of mixed dye aggregates enables adjustment of the spectral sensitivity of the emulsion to any wavelength between the extremes of the wavelengths of peak sensitivities (λ-max) of the two or more dyes. This practice is especially valuable if the two or more sensitizing dyes absorb in similar portions of the spectrum (i.e., blue, or green or red and not green plus red or blue plus red or green plus blue). Since the function of the spectral sensitizing dye is to modulate the information recorded in the negative which is recorded as an image dye, positioning the peak spectral sensitivity at or near the λ-max of the image dye in the color negative produces the optimum preferred response. In addition, the combination of similarly spectrally sensitized emulsions can be in one or more layers.

An important quality characteristic of a reproductive film system is color reproduction, which represents how accurately the hues of the original scene are reproduced. Many current color papers use a blue sensitizing dye that gives a maximum sensitivity at about 480 nm. Use of a sensitizing dye that affords a sensitivity maximum that is closer to that of the yellow image dye in film, for instance with a sensitivity maximum of around 450–470 nm, can result in a color paper with improved color reproduction.

Typical of image dye-forming couplers that may be included in the invention element are couplers that form cyan dyes upon reaction with oxidized color developing agents which are described in such representative patents and publications as: U.S. Pat. Nos. 2,367,531; 2,423,730; 2,474,293; 2,772,162; 2,895,826; 3,002,836; 3,034,892; 3,041,236; 4,883,746 and "Farbkuppler—Eine Literature Ubersicht," published in Agfa Mitteilungen, Band III, pp. 156–175 (1961). Preferably such couplers are phenols and naphthols that form cyan dyes on reaction with oxidized color developing agent. Also preferable are the cyan couplers described in, for instance, European Patent Application Nos. 491,197; 544,322; 556,700; 556,777; 565,096; 570,006; and 574,948.

Typical cyan couplers for the non-light sensitive interlayers and the color record layers are represented by the following formulas:

CYAN-1

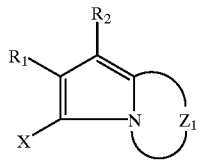

-continued

CYAN-2

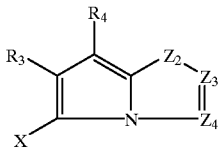

CYAN-3

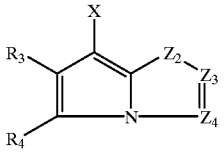

CYAN-4

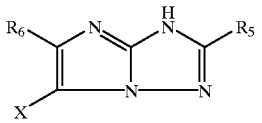

wherein $R_1$, $R_5$ and $R_8$ each represents a hydrogen or a substituent; $R_2$ represents a substituent; $R_3$, $R_4$ and $R_7$ each represents an electron attractive group having a Hammett's substituent constant σpara of 0.2 or more and the sum of the σpara values of $R_3$ and $R_4$ is 0.65 or more; $R_6$ represents an electron attractive group having a Hammett's substituent constant σpara of 0.35 or more; X represents a hydrogen or a coupling-off group; $Z_1$ represents nonmetallic atoms necessary for forming a nitrogen-containing, six-membered, heterocyclic ring which has at least one dissociative group; $Z_2$ represents—C($R_7$)═ and—N═; and $Z_3$ and $Z_4$ each represents—C($R_8$)═ and—N═.

For purposes of this invention, an "NB coupler" is a dye-forming coupler which is capable of coupling with the developer 4-amino-3-methyl-N-ethyl-N-(2-methanesulfonamidoethyl) aniline sesquisulfate hydrate to form a dye for which the left bandwidth (LBW) of its absorption spectra upon "spin coating" of a 3% w/v solution of the dye in di-n-butyl sebacate solvent is at least 5 nm. less than the LBW for a 3% w/v solution of the same dye in acetonitrile. The LBW of the spectral curve for a dye is the distance between the left side of the spectral curve and the wavelength of maximum absorption measured at a density of half the maximum.

The "spin coating" sample is prepared by first preparing a solution of the dye in di-n-butyl sebacate solvent (3% w/v). If the dye is insoluble, dissolution is achieved by the addition of some methylene chloride. The solution is filtered and 0.1–0.2 ml is applied to a clear polyethylene terephthalate support (approximately 4 cm×4 cm) and spun at 4,000 RPM using the Spin Coating equipment,. Model No. EC101, available from Headway Research Inc., Garland Tex. The transmission spectra of the so prepared dye samples are then recorded.

Preferred "NB couplers" form a dye which, in n-butyl sebacate, has a LBW of the absorption spectra upon "spin coating" which is at least 15 nm, preferably at least 25 nm, less than that of the same dye in a 3% solution (w/v) in acetonitrile.

In a preferred embodiment the cyan dye-forming "NB coupler" useful in the invention has the formula (IA)

(IA)

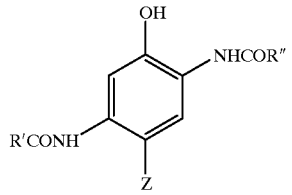

wherein

R' and R" are substituents selected such that the coupler is a "NB coupler", as herein defined; and Z is a hydrogen atom or a group which can be split off by the reaction of the coupler with an oxidized color developing agent.

The coupler of formula (IA) is a 2,5-diamido phenolic cyan coupler wherein the substituents R' and R" are preferably independently selected from unsubstituted or substituted alkyl, aryl, amino, alkoxy and heterocyclyl groups.

In a further preferred embodiment, the "NB coupler" has the formula (I):

(I)

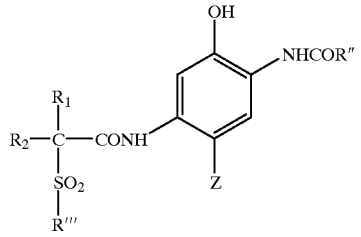

wherein

R" and R'" are independently selected from unsubstituted or substituted alkyl, aryl, amino, alkoxy and heterocyclyl groups and Z is as hereinbefore defined;

$R_1$ and $R_2$ are independently hydrogen or an unsubstituted or substituted alkyl group; and Typically, R" is an alkyl, amino or aryl group, suitably a phenyl group. R'" is desirably an alkyl or aryl group or a 5–10 membered heterocyclic ring which contains one or more heteroatoms selected from nitrogen, oxygen and sulfur, which ring group is unsubstituted or substituted.

In the preferred embodiment the coupler of formula (I) is a 2,5-diamido phenol in which the 5-amido moiety is an amide of a carboxylic acid which is substituted in the alpha position by a particular sulfone (—$SO_2$—) group, such as, for example, described in U.S. Pat. No. 5,686,235. The sulfone moiety is an unsubstituted or substituted alkylsulfone or a heterocyclyl sulfone or it is an arylsulfone, which is preferably substituted, in particular in the meta and/or para position.

Couplers having these structures of formulae (I) or (IA) comprise cyan dye-forming "NB couplers" which form image dyes having very sharp-cutting dye hues on the short wavelength side of the absorption curves with absorption maxima ($\lambda_{max}$) which are shifted hypsochromically and are generally in the range of 620–645 nm, which is ideally suited for producing excellent color reproduction and high color saturation in color photographic papers.

Referring to formula (I), $R_1$ and $R_2$ are independently hydrogen or an unsubstituted or substituted alkyl group, preferably having from 1 to 24 carbon atoms and in particular 1 to 10 carbon atoms, suitably a methyl, ethyl, n-propyl, isopropyl, butyl or decyl group or an alkyl group substituted with one or more fluoro, chloro or bromo atoms, such as a trifluoromethyl group. Suitably, at least one of $R_1$ and $R_2$ is a hydrogen atom and if only one of $R_1$ and $R_2$ is a hydrogen atom then the other is preferably an alkyl group having 1 to 4 carbon atoms, more preferably one to three carbon atoms and desirably two carbon atoms.

As used herein and throughout the specification unless where specifically stated otherwise, the term "alkyl" refers to an unsaturated or saturated straight or branched chain alkyl group, including alkenyl, and includes aralkyl and cyclic alkyl groups, including cycloalkenyl, having 3–8 carbon atoms and the term 'aryl' includes specifically fused aryl.

In formula (I), R" is suitably an unsubstituted or substituted amino, alkyl or aryl group or a 5–10 membered heterocyclic ring which contains one or more heteroatoms selected from nitrogen, oxygen and sulfur, which ring is unsubstituted or substituted, but is more suitably an unsubstituted or substituted phenyl group.

Examples of suitable substituent groups for this aryl or heterocyclic ring include cyano, chloro, fluoro, bromo, iodo, alkyl- or aryl-carbonyl, alkyl- or aryl-oxycarbonyl, carbonamido, alkyl- or aryl-carbonamido, alkyl- or aryl-sulfonyl, alkyl- or aryl-sulfonyloxy, alkyl- or aryl-oxysulfonyl, alkyl- or aryl-sulfoxide, alkyl- or aryl-sulfamoyl, alkyl- or aryl-sulfonamido, aryl, alkyl, alkoxy, aryloxy, nitro, alkyl- or aryl-ureido and alkyl- or aryl-carbamoyl groups, any of which may be further substituted. Preferred groups are halogen, cyano, alkoxycarbonyl, alkylsulfamoyl, alkyl-sulfonamido, alkylsulfonyl, carbamoyl, alkylcarbamoyl or alkylcarbonamido. Suitably, R" is a 4-chlorophenyl, 3,4-di-chlorophenyl, 3,4-difluorophenyl, 4-cyanophenyl, 3-chloro-4-cyanophenyl, pentafluorophenyl, or a 3- or 4-sulfonamidophenyl group.

In formula (I) when R'" is alkyl, it may be unsubstituted or substituted with a substituent such as halogen or alkoxy. When R'" is aryl or a heterocycle, it may be substituted. Desirably it is not substituted in the position alpha to the sulfonyl group.

In formula (I), when R'" is a phenyl group, it may be substituted in the meta and/or para positions with one to three substituents independently selected from the group consisting of halogen, and unsubstituted or substituted alkyl, alkoxy, aryloxy, acyloxy, acylamino, alkyl- or aryl-sulfonyloxy, alkyl- or aryl-sulfamoyl, alkyl- or aryl-sulfamoylamino, alkyl- or aryl-sulfonamido, alkyl-or aryl-ureido, alkyl- or aryl-oxycarbonyl, alkyl- or aryl-oxycarbonylamino and alkyl- or aryl-carbamoyl groups.

In particular each substituent may be an alkyl group such as methyl, t-butyl, heptyl, dodecyl, pentadecyl, octadecyl or 1,1,2,2-tetramethylpropyl; an alkoxy group such as methoxy, t-butoxy, octyloxy, dodecyloxy, tetradecyloxy, hexadecyloxy or octadecyloxy; an aryloxy group such as phenoxy, 4-t-butylphenoxy or 4-dodecyl-phenoxy; an alkyl- or aryl-acyloxy group such as acetoxy or dodecanoyloxy; an alkyl- or aryl-acylamino group such as acetamido, hexadecanamido or benzamido; an alkyl- or aryl-sulfonyloxy group such as methyl-sulfonyloxy, dodecylsulfonyloxy or 4-methylphenyl-sulfonyloxy; an alkyl- or aryl-sulfamoyl-group such as N-butylsulfamoyl or N-4-t-butylphenylsulfamoyl; an alkyl- or aryl-sulfamoylamino group such as N-butyl-sulfamoylamino or N-4-t-butylphenylsulfamoyl-amino; an alkyl- or aryl-sulfonamido group such as methane-sulfonamido, hexadecanesulfonamido or 4-chlorophenyl-sulfonamido; an alkyl- or aryl-ureido group such as methylureido or phenylureido; an alkoxy- or aryloxy-carbonyl such as methoxycarbonyl or phenoxycarbonyl; an alkoxy- or aryloxy-carbonylamino group such as methoxy-carbonylamino or phenoxycarbonylamino; an alkyl- or aryl-carbamoyl group such as N-butylcarbamoyl or N-methyl-N-dodecylcarbamoyl; or a perfluoroalkyl group such as trifluoromethyl or heptafluoropropyl.

Suitably the above substituent groups have 1 to 30 carbon atoms, more preferably 8 to 20 aliphatic carbon atoms. A desirable substituent is an alkyl group of 12 to 18 aliphatic carbon atoms such as dodecyl, pentadecyl or octadecyl or an alkoxy group with 8 to 18 aliphatic carbon atoms such as dodecyloxy and hexadecyloxy or a halogen such as a meta or para chloro group, carboxy or sulfonamido. Any such groups may contain interrupting heteroatoms such as oxygen to form e.g. polyalkylene oxides.

In formula (I) or (IA) Z is a hydrogen atom or a group which can be split off by the reaction of the coupler with an oxidized color developing agent, known in the photographic art as a 'coupling-off group' and may preferably be hydrogen, chloro, fluoro, substituted aryloxy or mercaptotetrazole, more preferably hydrogen or chloro.

The presence or absence of such groups determines the chemical equivalency of the coupler, i.e., whether it is a 2-equivalent or 4-equivalent coupler, and its particular identity can modify the reactivity of the coupler. Such groups can advantageously affect the layer in which the coupler is coated, or other layers in the photographic recording material, by performing, after release from the coupler, functions such as dye formation, dye hue adjustment, development acceleration or inhibition, bleach acceleration or inhibition, electron transfer facilitation, color correction, and the like.

Representative classes of such coupling-off groups include, for example, halogen, alkoxy, aryloxy, heterocyclyloxy, sulfonyloxy, acyloxy, acyl, heterocyclylsulfonamido, heterocyclylthio, benzothiazolyl, phosophonyloxy, alkylthio, arylthio, and arylazo. These coupling-off groups are described in the art, for example, in U.S. Pat. Nos. 2,455,169; 3,227,551; 3,432,521; 3,467,563; 3,617,291; 3,880,661; 4,052,212; and 4,134,766; and in U.K. Patent Nos. and published applications 1,466,728; 1,531,927; 1,533,039; 2,066,755A, and 2,017,704A. Halogen, alkoxy and aryloxy groups are most suitable.

Examples of specific coupling-off groups are —Cl, —F, —Br, —SCN, $—OCH_3$, $—OC_6H_5$, $—OCH_2C(=O)NHCH_2CH_2OH$, $—OCH_2C(O)NHCH_2CH_2OCH_3$, $—OCH_2C(O)NHCH_2CH_2OC(=O)OCH_3$, $—P(=O)(OC_2H_5)_2$, $—SCH_2CH_2COOH$,

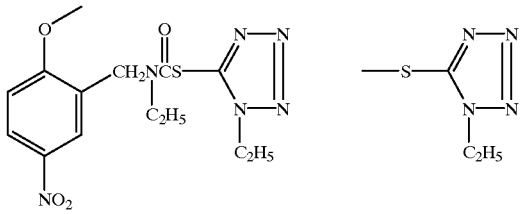

-continued

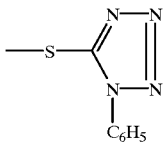

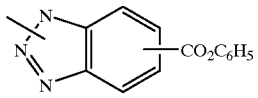

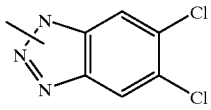

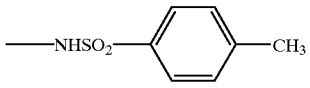

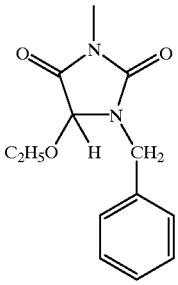

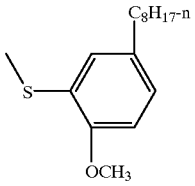

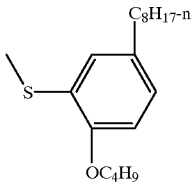

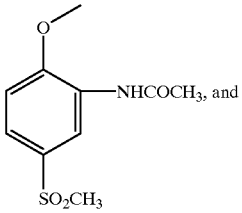

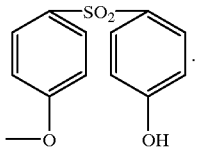

Typically, the coupling-off group is a chlorine atom, hydrogen atom or p-methoxyphenoxy group.

It is essential that the substituent groups be selected so as to adequately ballast the coupler and the resulting dye in the organic solvent in which the coupler is dispersed. The ballasting may be accomplished by providing hydrophobic substituent groups in one or more of the substituent groups. Generally a ballast group is an organic radical of such size and configuration as to confer on the coupler molecule sufficient bulk and aqueous insolubility as to render the coupler substantially nondiffusible from the layer in which it is coated in a photographic element. Thus, the combination of substituent are suitably chosen to meet these criteria. To be effective, the ballast will usually contain at least 8 carbon atoms and typically contains 10 to 30 carbon atoms. Suitable ballasting may also be accomplished by providing a plurality of groups which in combination meet these criteria. In the preferred embodiments of the invention $R_1$ in formula (I) is a small alkyl group or hydrogen. Therefore, in these embodiments the ballast would be primarily located as part of the other groups. Furthermore, even if the coupling-off group Z contains a ballast it is often necessary to ballast the other substituents as well, since Z is eliminated from the molecule upon coupling; thus, the ballast is most advantageously provided as part of groups other than Z.

The following examples further illustrate preferred cyan coupler utilized in the invention. It is not to be construed that the present invention is limited to these examples.

IC-1

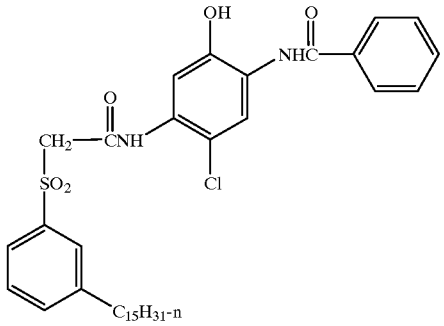

IC-2

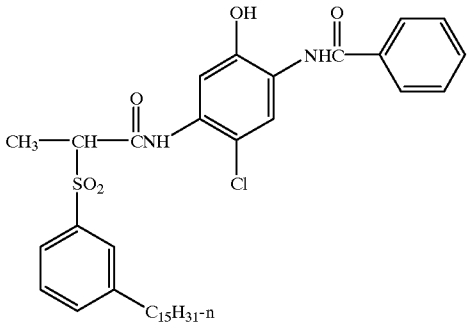

IC-3

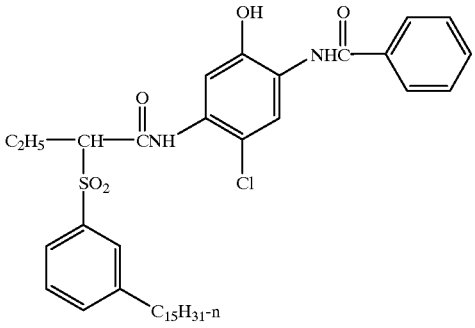

IC-4

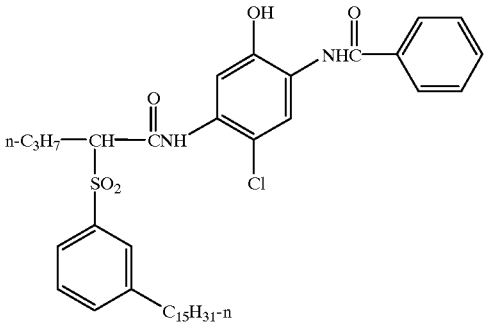

-continued
IC-5
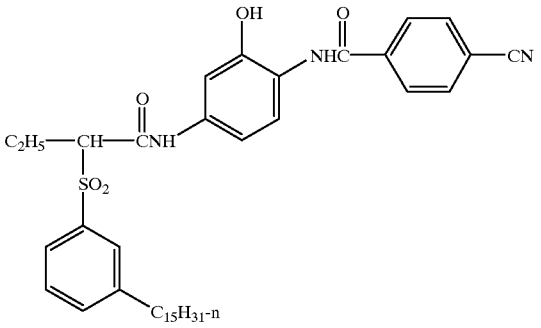
IC-6
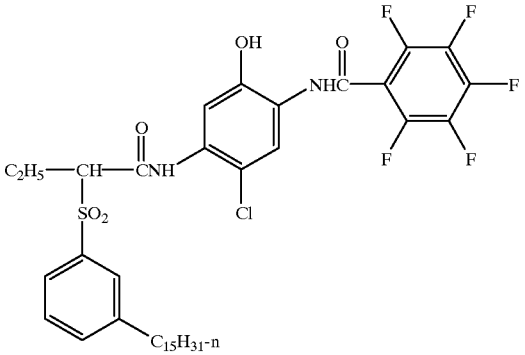
IC-7
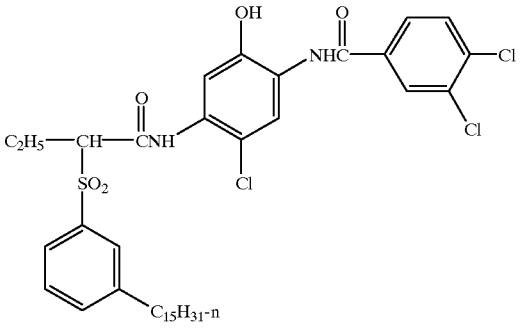
IC-8
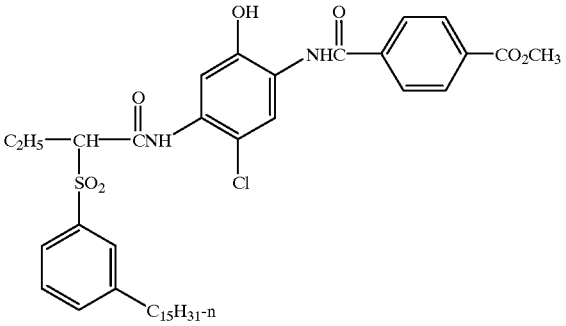
-continued
IC-9
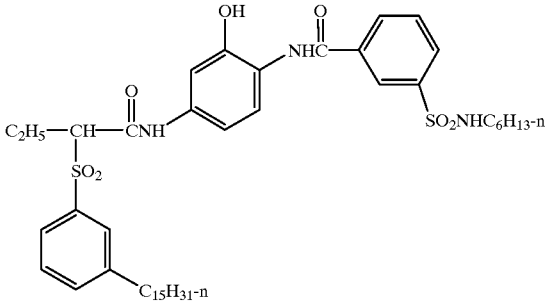
IC-10
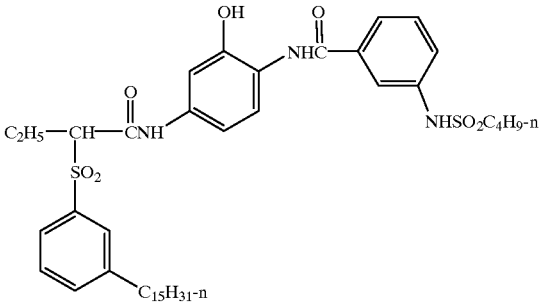
IC-11
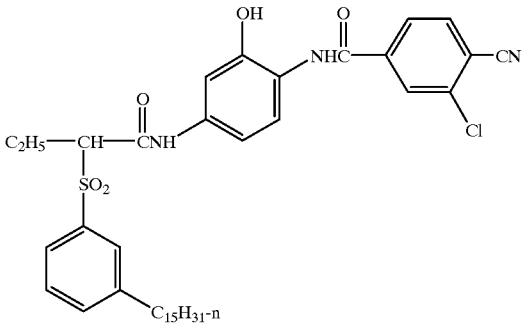
IC-12
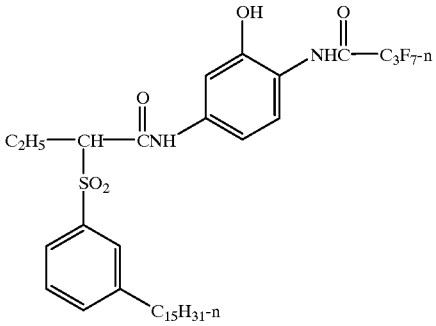

-continued
IC-13
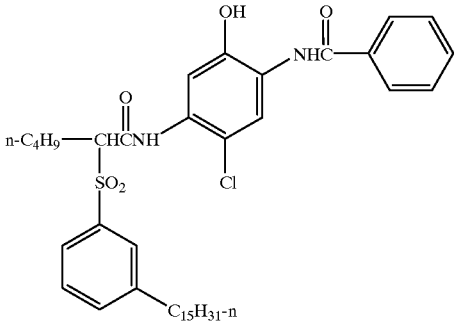
IC-14
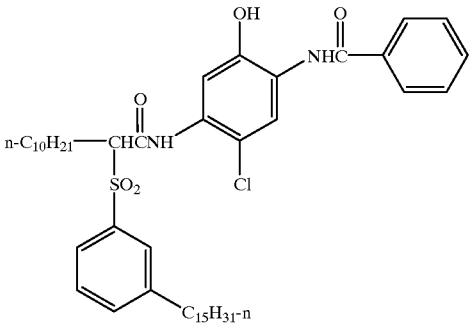
IC-15
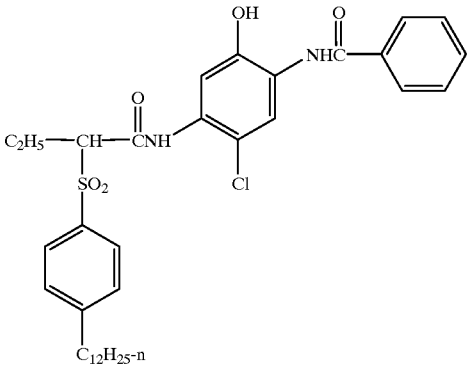
IC-16
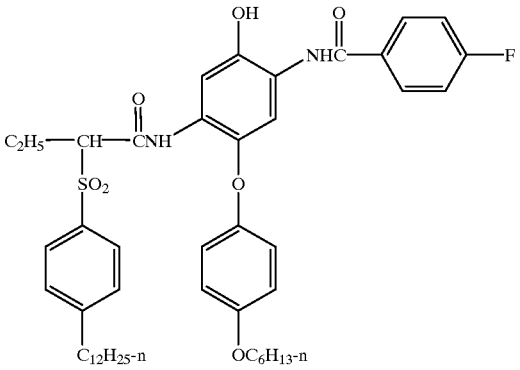
-continued
IC-17
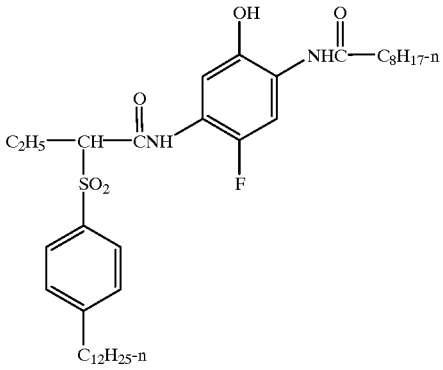
IC-18
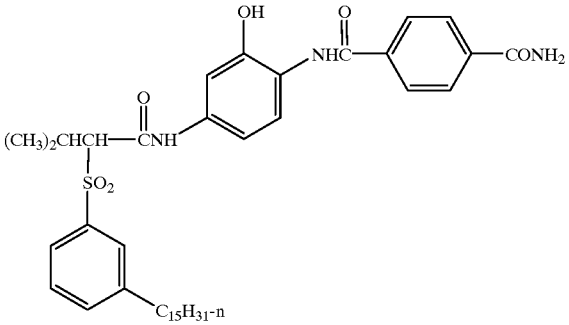
IC-19
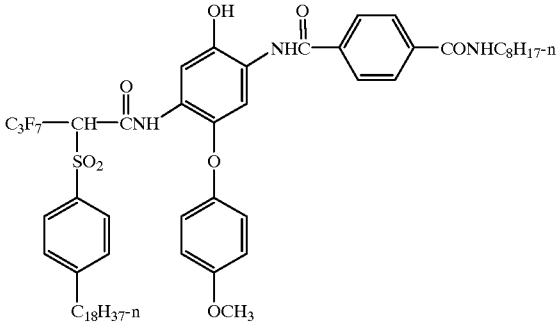
IC-20
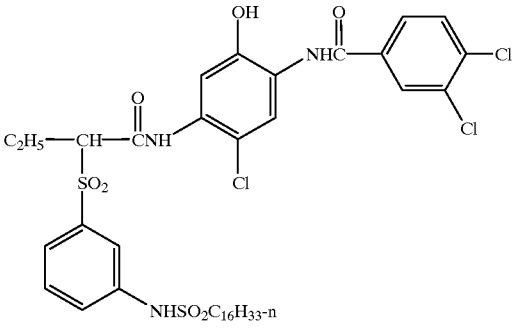

-continued
IC-21
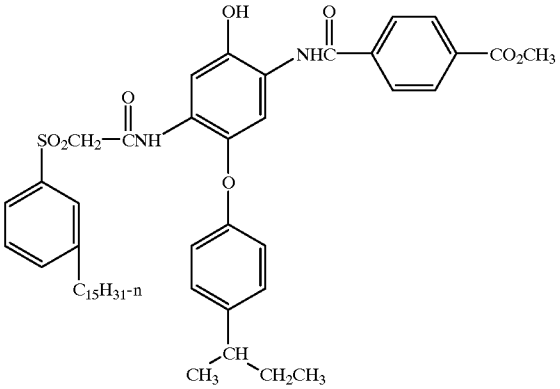
IC-22
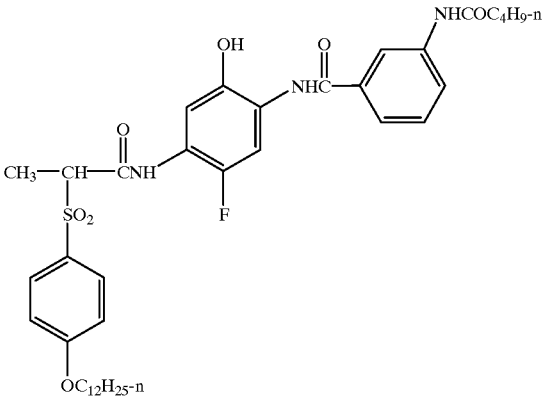
IC-23
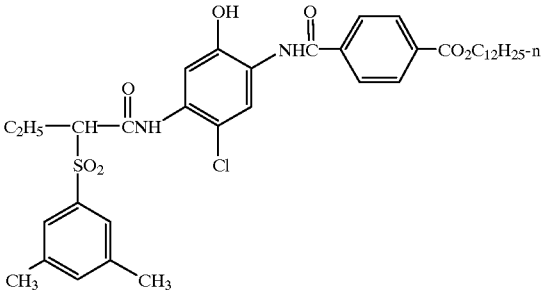
IC-24
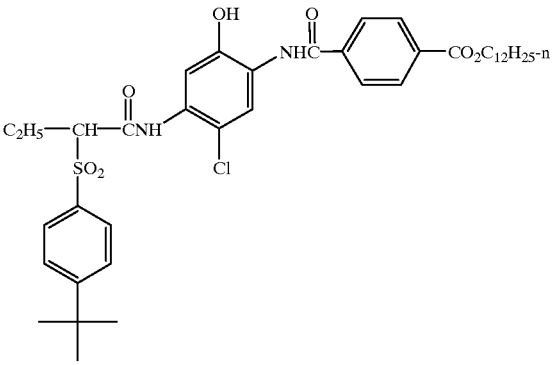
-continued
IC-25
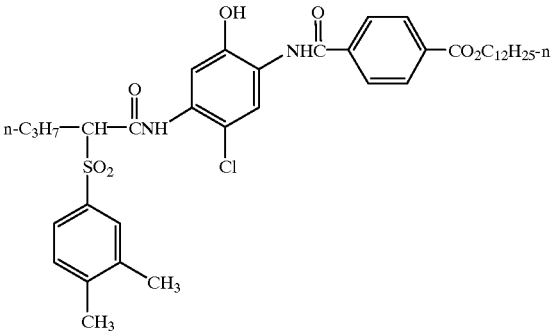
IC-26
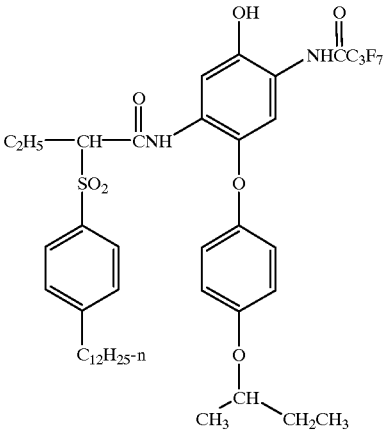
IC-27
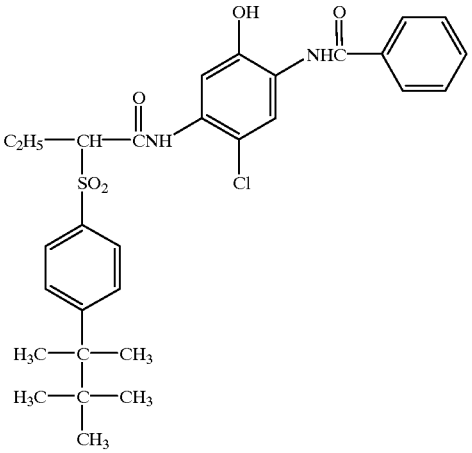
IC-28
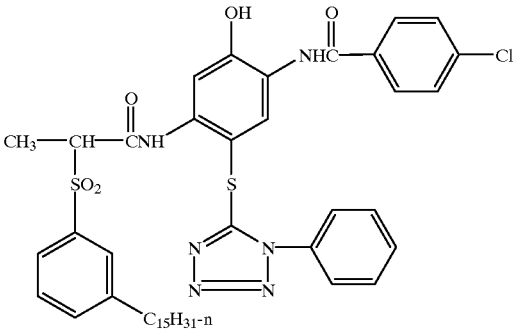

-continued
IC-29
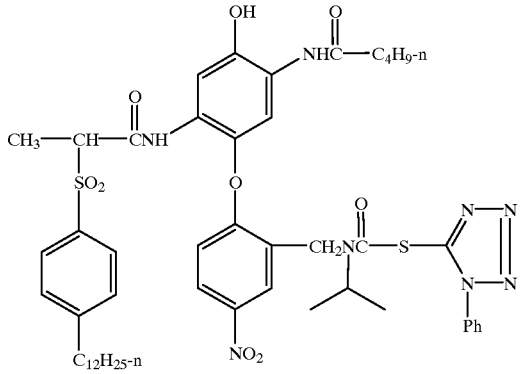
IC-30
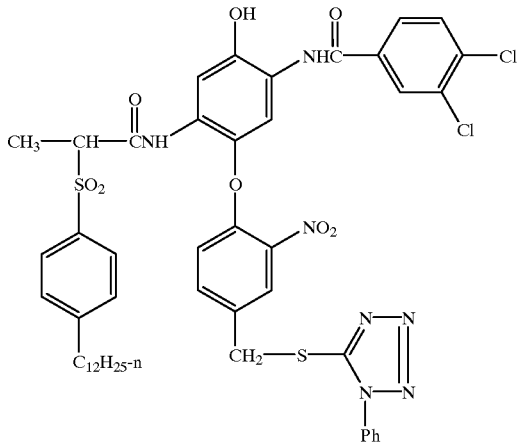
IC-31
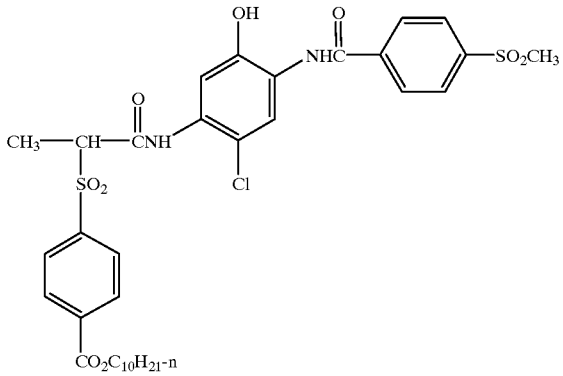
-continued
IC-32
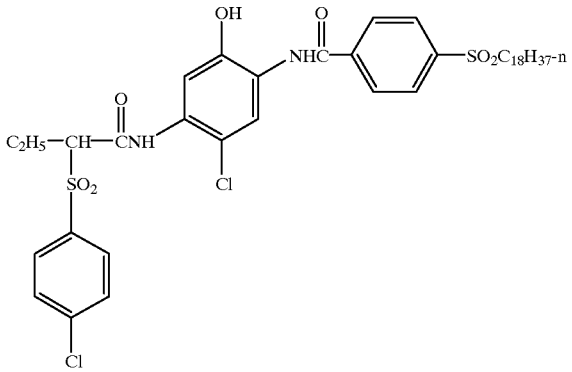
IC-33
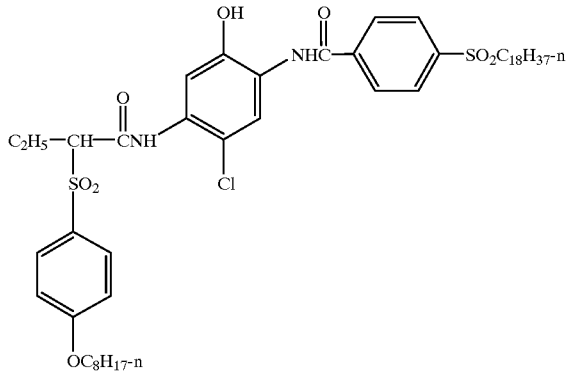
IC-34
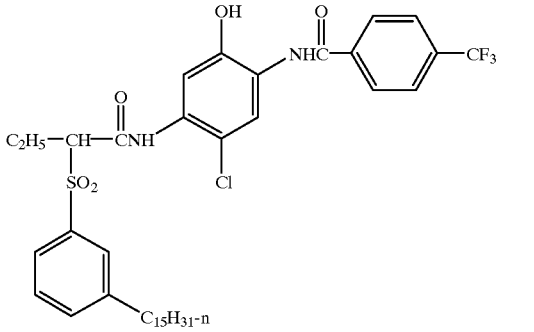
IC-35
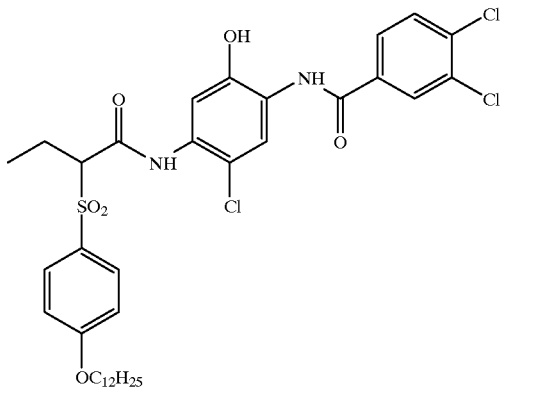

-continued

IC-36

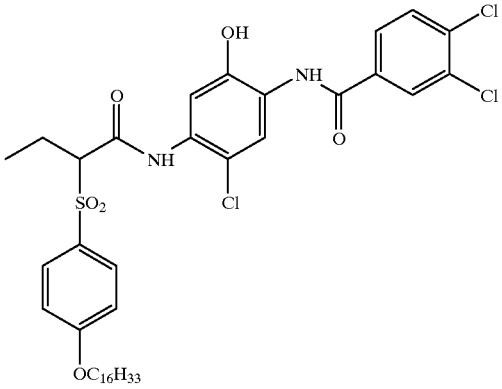

IC-37

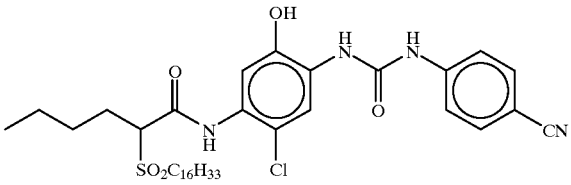

IC-38

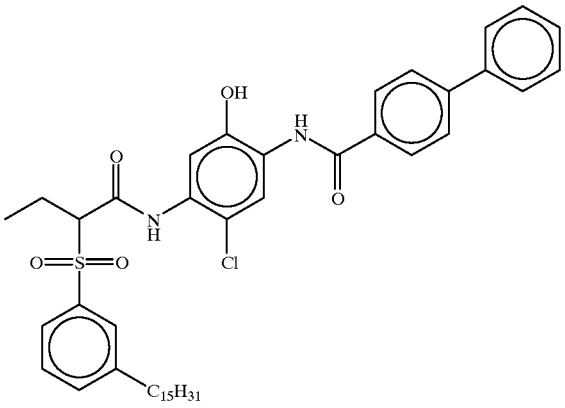

IC-39

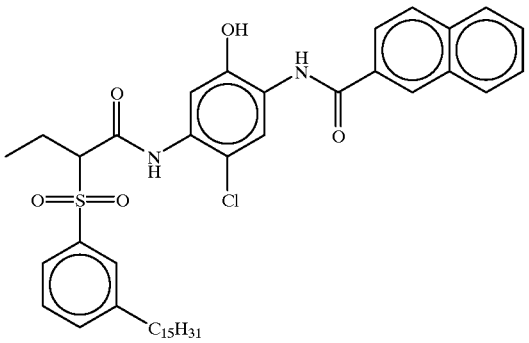

-continued

IC-40

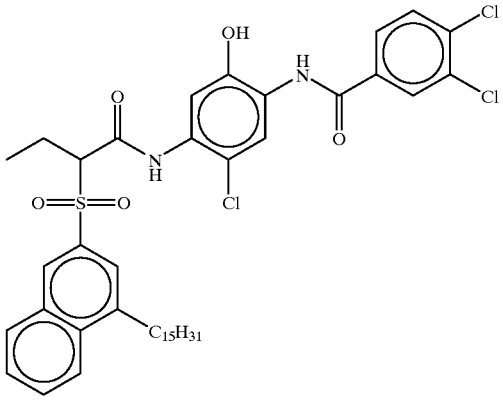

Preferred couplers are IC-3, IC-7, IC-35, and IC-36 because of their suitably narrow left bandwidths.

Typical couplers that form magenta dyes upon reaction with oxidized color developing agent are described in such representative patents and publications as: U.S. Pat. Nos. 2,311,082; 2,343,703; 2,369,489; 2,600,788; 2,908,573; 3,062,653; 3,152,896; 3,519,429; 3,758,309, and "Farbkuppler-eine Literature Ubersicht," published in Agfa Mitteilungen, Band III, pp. 126–156 (1961). Preferably such couplers are pyrazolones, pyrazolotriazoles, or pyrazolobenzimidazoles that form magenta dyes upon reaction with oxidized color developing agents. Especially preferred couplers are 1H-pyrazolo [5,1-c]-1,2,4-triazole and 1H-pyrazolo [1,5-b]-1,2,4-triazole. Examples of 1H-pyrazolo [5,1-c]-1,2,4-triazole couplers are described in U.K. Patent Nos. 1,247,493; 1,252,418; 1.398,979; U.S. Pat. Nos. 4,443,536; 4,514,490; 4,540,654; 4,590,153; 4,665,015; 4,822,730; 4,945,034; 5,017,465; and 5,023,170. Examples of 1H-pyrazolo [1,5-b]-1,2,4-triazoles can be found in European Patent applications 176,804; 177,765; U.S Pat. Nos. 4,659,652; 5,066,575; and 5,250,400.

Typical pyrazoloazole and pyrazolone couplers are represented by the following formulas:

MAGENTA-1

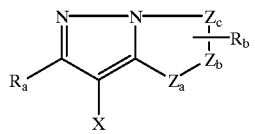

MAGENTA-2

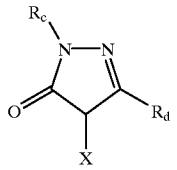

wherein $R_a$ and $R_b$ independently represent H or a substituent; $R_c$ is a substituent (preferably an aryl group); $R_d$ is a substituent (preferably an anilino, carbonamido, ureido, carbamoyl, alkoxy, aryloxycarbonyl, alkoxycarbonyl, or N-heterocyclic group); X is hydrogen or a coupling-off group; and $Z_a$, $Z_b$, and $Z_c$ are independently a substituted methine group, =N—, =C—, or —NH—, provided that one of either the $Z_a$—$Z_b$ bond or the $Z_b$—$Z_c$ bond is a double bond and the other is a single bond, and when the $Z_b$—$Z_c$ bond is a carbon-carbon double bond, it may form part of an aromatic ring, and at least one of $Z_a$, $Z_b$, and $Z_c$ represents a methine group connected to the group $R_b$.

Specific examples of such couplers suitable for use in the color record layers or interlayers of the invention are:

M-1

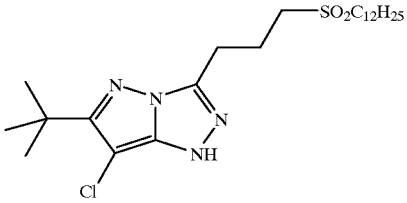

M-2

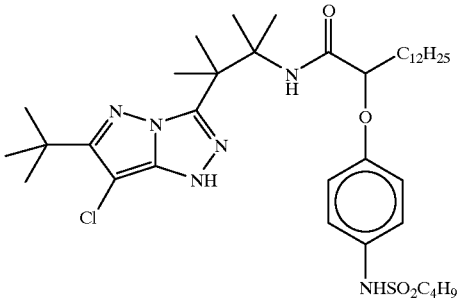

M-3

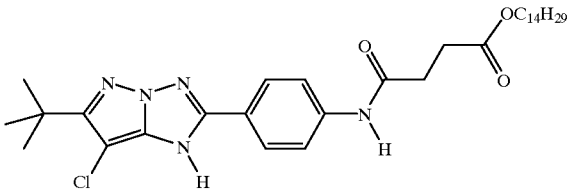

M-4

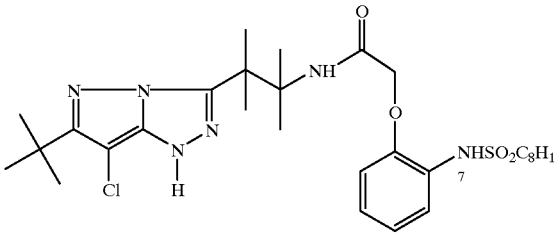

M-5

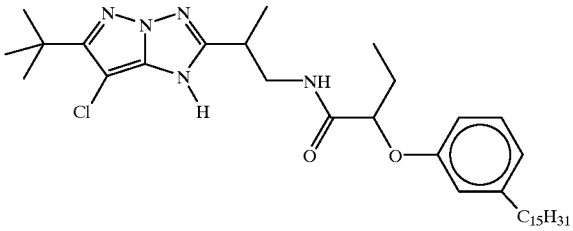

Typical couplers that form yellow dyes upon reaction with oxidized color developing agent are described in such representative patents and publications as: U.S. Pat. Nos. 2,298,443; 2,407,210; 2,875,057; 3,048,194; 3,265,506; 3,447,928; 3,960,570; 4,022,620; 4,443,536; 4,910,126; and 5,340,703 and "Farbkuppler-eine Literature Ubersicht," published in Agfa Mitteilungen, Band III, pp. 112–126 (1961). Such couplers are typically open chain ketomethylene compounds. Also preferred are yellow couplers such as described in, for example, European Patent Application Nos. 482,552; 510,535; 524,540; 543,367; and U.S. Pat. No. 5,238,803. For improved color reproduction, couplers which give yellow dyes that cut off sharply on the long wavelength side are particularly preferred (for example, see U.S. Pat. No. 5,360,713).

Typical preferred yellow couplers are represented by the following formulas:

YELLOW-1

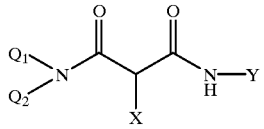

YELLOW-2

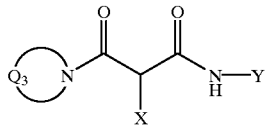

YELLOW-3

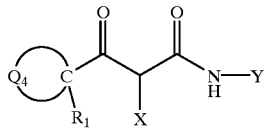

YELLOW-4

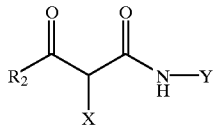

wherein $R_1$, $R_2$, $Q_1$ and $Q_2$ each represents a substituent; X is hydrogen or a coupling-off group; Y represents an aryl group or a heterocyclic group; $Q_3$ represents an organic residue required to form a nitrogen-containing heterocyclic group together with the>N—; and $Q_4$ represents nonmetallic atoms necessary to from a 3- to 5-membered hydrocarbon ring or a 3- to 5-membered heterocyclic ring which contains at least one hetero atom selected from N, O, S, and P in the ring. Particularly preferred is when $Q_1$ and $Q_2$ each represents an alkyl group, an aryl group, or a heterocyclic group, and $R_2$ represents an aryl or tertiary alkyl group.

Preferred yellow couplers for the blue color record and adjacent interlayers can be of the following general structures:

Y-1

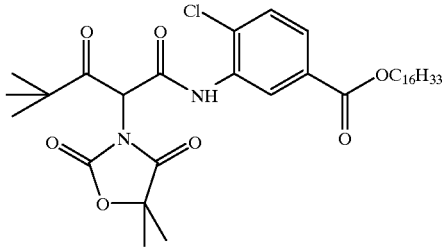

-continued

Y-2

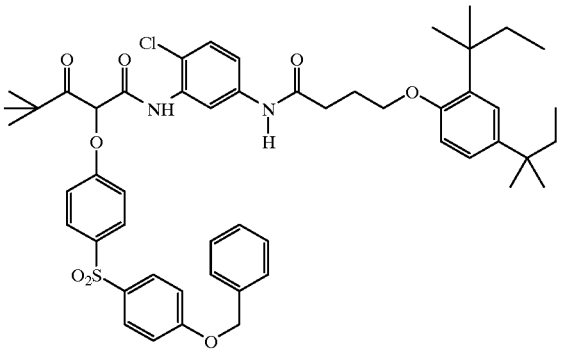

Y-3

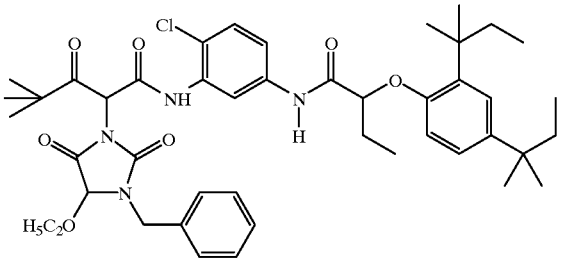

Y-4

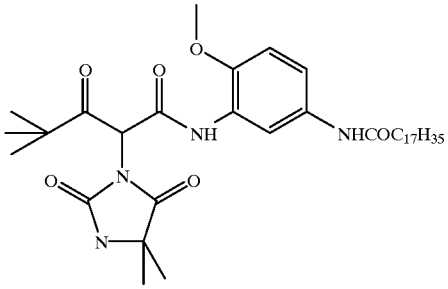

Y-5

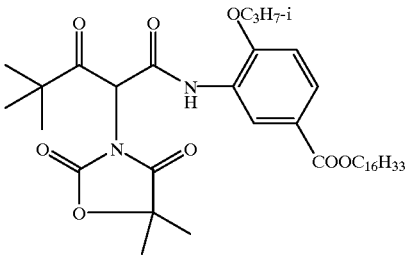

Y-6

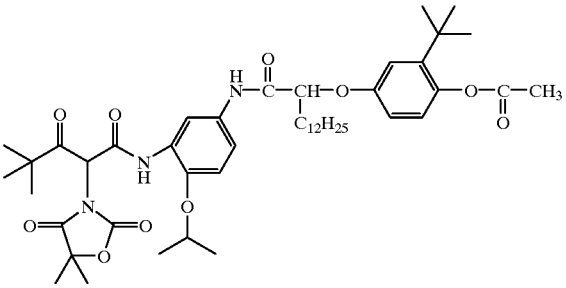

Unless otherwise specifically stated, substituent groups which may be substituted on molecules herein include any groups, whether substituted or unsubstituted, which do not destroy properties necessary for photographic utility. When the term "group" is applied to the identification of a substituent containing a substitutable hydrogen, it is intended to encompass not only the substituent's unsubstituted form, but also its form further substituted with any group or groups as herein mentioned. Suitably, the group may be halogen or may be bonded to the remainder of the molecule by an atom of carbon, silicon, oxygen, nitrogen, phosphorous, or sulfur. The substituent may be, for example, halogen, such as chlorine, bromine or fluorine; nitro; hydroxyl; cyano; carboxyl; or groups which may be further substituted, such as alkyl, including straight or branched chain alkyl, such as methyl, trifluoromethyl, ethyl, t-butyl, 3-(2,4-di-t-pentylphenoxy) propyl, and tetradecyl; alkenyl, such as ethylene, 2-butene; alkoxy, such as methoxy, ethoxy, propoxy, butoxy, 2-methoxyethoxy, sec-butoxy, hexyloxy, 2-ethylhexyloxy, tetradecyloxy, 2-(2,4-di-t-pentylphenoxy) ethoxy, and 2-dodecyloxyethoxy; aryl such as phenyl, 4-t-butylphenyl, 2,4,6-trimethylphenyl, naphthyl; aryloxy, such as phenoxy, 2-methylphenoxy, alpha- or beta-naphthyloxy, and 4-tolyloxy; carbonamido, such as acetamido, benzamido, butyramido, tetradecanamido, alpha-(2,4-di-t-pentyl-phenoxy)acetamido, alpha-(2,4-di-t-pentylphenoxy) butyramido, alpha-(3-pentadecylphenoxy)-hexanamido, alpha-(4-hydroxy-3-t-butylphenoxy)-tetradecanamido, 2-oxo-pyrrolidin-1-yl, 2-oxo-5-tetradecylpyrrolin-1-yl, N-methyltetradecanamido, N-succinimido, N-phthalimido, 2,5-dioxo-1-oxazolidinyl, 3-dodecyl-2,5-dioxo-1-imidazolyl, and N-acetyl-N-dodecylamino, ethoxycarbonylamino, phenoxycarbonylamino, benzyloxycarbonylamino, hexadecyloxycarbonylamino, 2,4-di-t-butylphenoxycarbonylamino, phenylcarbonylamino, 2,5-(di-t-pentylphenyl) carbonylamino, p-dodecyl-phenylcarbonylamino, p-toluylcarbonylamino, N-methylureido, N,N-dimethylureido, N-methyl-N-dodecylureido, N-hexadecylureido, N,N-dioctadecylureido, N,N-dioctyl-N'-ethylureido, N-phenylureido, N,N-diphenylureido, N-phenyl-N-p-toluylureido, N-(m-hexadecylphenyl)ureido, N,N-(2,5-di-t-pentylphenyl)-N'-ethylureido, and t-butylcarbonamido; sulfonamido, such as methylsulfonamido, benzenesulfonamido, p-toluylsulfonamido, p-dodecylbenzenesulfonamido, N-methyltetradecylsulfonamido, N,N-dipropyl-sulfamoylamino, and hexadecylsulfonamido; sulfamoyl, such as N-methylsulfamoyl, N-ethylsulfamoyl, N,N-dipropylsulfamoyl, N-hexadecylsulfamoyl, N,N-dimethylsulfamoyl; N-[3-(dodecyloxy)propyl]sulfamoyl, N-[4-(2,4-di-t-pentylphenoxy)butyl]sulfamoyl, N-methyl-N-tetradecylsulfamoyl, and N-dodecylsulfamoyl; carbamoyl, such as N-methylcarbamoyl, N,N-dibutylcarbamoyl, N-octadecylcarbamoyl, N-[4-(2,4-di-t-pentylphenoxy)butyl]carbamoyl, N-methyl-N-tetradecylcarbamoyl, and N,N-dioctylcarbamoyl; acyl, such as acetyl, (2,4-di-t-amylphenoxy)acetyl, phenoxycarbonyl, p-dodecyloxyphenoxycarbonyl, methoxycarbonyl, butoxycarbonyl, tetradecyloxycarbonyl, ethoxycarbonyl, benzyloxycarbonyl, 3-pentadecyloxycarbonyl, and dodecyloxycarbonyl; sulfonyl, such as methoxysulfonyl, octyloxysulfonyl, tetradecyloxysulfonyl, 2-ethylhexyloxysulfonyl, phenoxysulfonyl, 2,4-di-t-pentylphenoxysulfonyl, methylsulfonyl, octylsulfonyl, 2-ethylhexylsulfonyl, dodecylsulfonyl, hexadecylsulfonyl, phenylsulfonyl, 4-nonylphenylsulfonyl, and p-toluylsulfonyl; sulfonyloxy, such as dodecylsulfonyloxy, and hexadecylsulfonyloxy; sulfinyl, such as methylsulfinyl, octylsulfinyl, 2-ethylhexylsulfinyl, dodecylsulfinyl, hexadecylsulfinyl, phenylsulfinyl, 4-nonylphenylsulfinyl, and p-toluylsulfinyl; thio, such as ethylthio, octylthio, benzylthio, tetradecylthio, 2-(2,4-di-t-pentylphenoxy) ethylthio, phenylthio, 2-butoxy-5-t-octylphenylthio, and p-tolylthio; acyloxy, such as acetyloxy, benzoyloxy, octadecanoyloxy, p-dodecylamidobenzoyloxy, N-phenylcarbamoyloxy, N-ethylcarbamoyloxy, and cyclohexylcarbonyloxy; amino, such as phenylanilino, 2-chloroanilino, diethylamino, dodecylamino; imino, such as 1 (N-phenylimido)ethyl, N-succinimido or 3-benzylhydantoinyl; phosphate, such as dimethylphosphate and ethylbutylphosphate; phosphite, such as diethyl and dihexylphosphite; a heterocyclic group, a heterocyclic oxy group or a heterocyclic thio group, each of which may be substituted and which contain a 3 to 7 membered heterocyclic ring composed of carbon atoms and at least one hetero atom selected from the group consisting of oxygen, nitrogen and sulfur, such as 2-furyl, 2-thienyl, 2-benzimidazolyloxy or 2-benzothiazolyl; quaternary ammonium, such as triethylammonium; and silyloxy, such as trimethylsilyloxy.

If desired, the substituents may themselves be further substituted one or more times with the described substituent groups. The particular substituents used may be selected by those skilled in the art to attain the desired photographic properties for a specific application and can include, for example, hydrophobic groups, solubilizing groups, blocking groups, releasing or releasable groups, etc. Generally, the above groups and substituents thereof may include those having up to 48 carbon atoms, typically 1 to 36 carbon atoms and usually less than 24 carbon atoms, but greater numbers are possible depending on the particular substituents selected.

Representative substituents on ballast groups include alkyl, aryl, alkoxy, aryloxy, alkylthio, hydroxy, halogen, alkoxycarbonyl, aryloxcarbonyl, carboxy, acyl, acyloxy, amino, anilino, carbonamido, carbamoyl, alkylsulfonyl, arylsulfonyl, sulfonamido, and sulfamoyl groups wherein the substituents typically contain 1 to 42 carbon atoms. Such substituents can also be further substituted.

Stabilizers and scavengers that can be used in these photographic elements, but are not limited to, the following:

ST-1

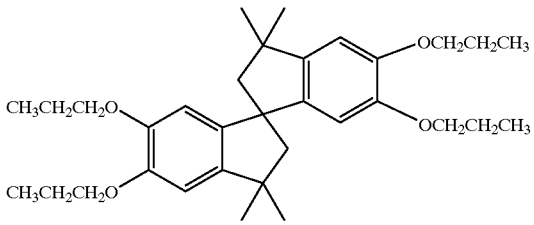

ST-2

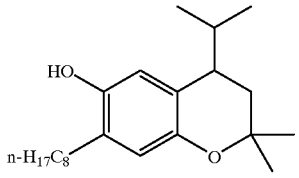

-continued

ST-3

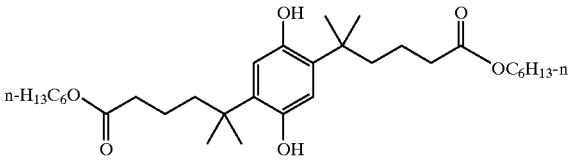

ST-4

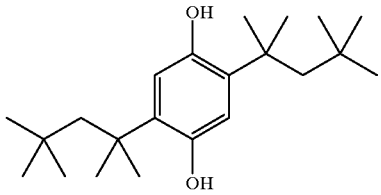

ST-5

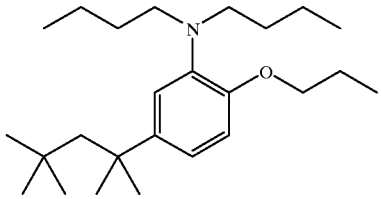

ST-6

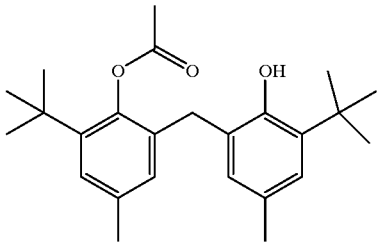

ST-7

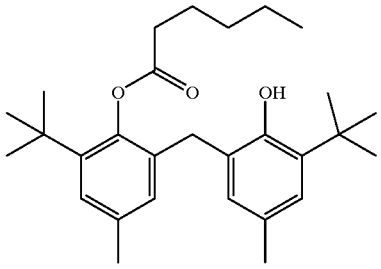

ST-8

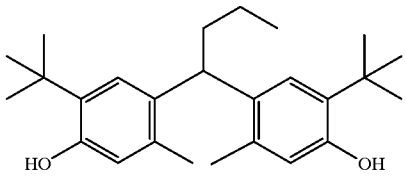

ST-9

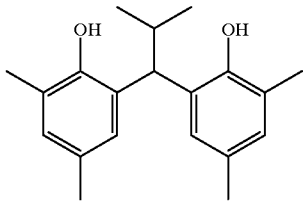

-continued
ST-10
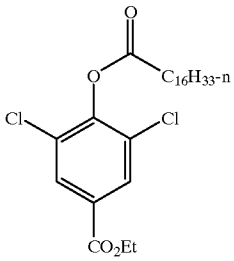
ST-11
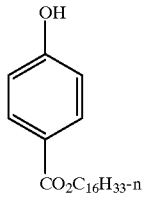
ST-12
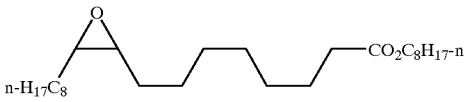
ST-13
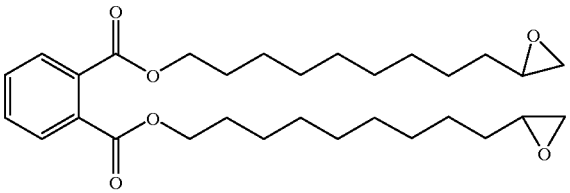
ST-14
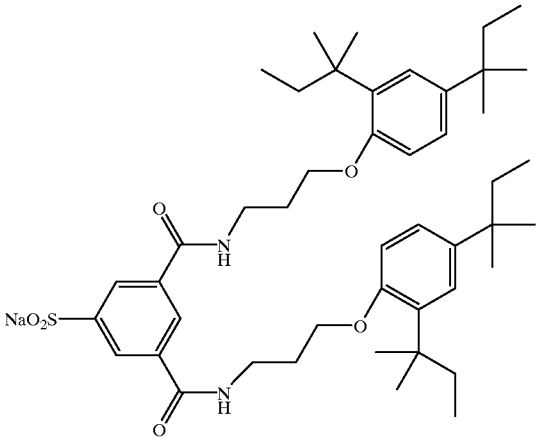
ST-15
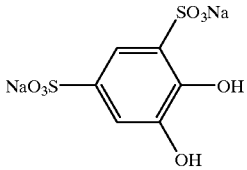
-continued
ST-16
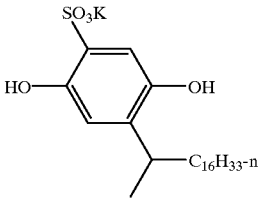
ST-17
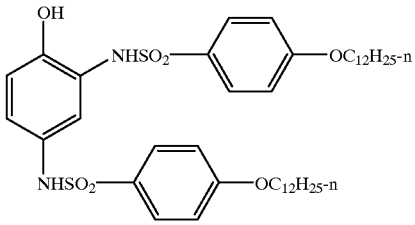
ST-18
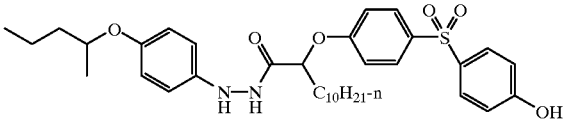
ST-19
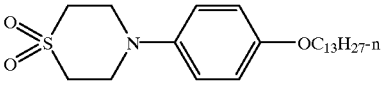
ST-20
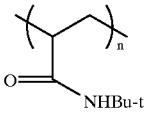
n = 75–8,000
ST-21
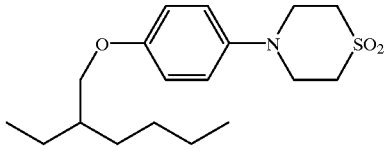
ST-22
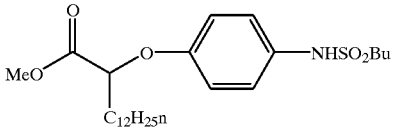
ST-23
2,5-Dihydroxy-5-methyl-3-(1-piperidinyl)-2-cyclopenten-1-one
PHR
ST-24
1-Phenyl-5-mercaptotetrazole
PMT
ST-25
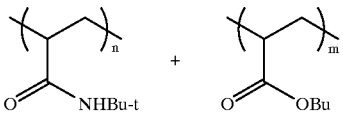
n:m 1:1 mw = 75–100,000

-continued

ST-26

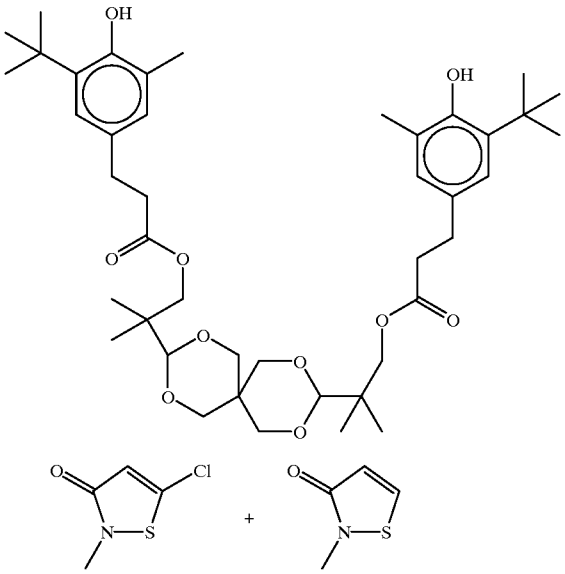

Kathon™ (416233) Biocide

Examples of solvents which may be used with the couplers in the invention photographic elements include the following:

| | |
|---|---|
| Tritolyl phosphate | S-1 |
| Dibutyl phthalate | S-2 |
| Diundecyl phthalate | S-3 |
| N,N-Diethyldodecanamide | S-4 |
| N,N-Dibutyldodecanamide | S-5 |
| Tris(2-ethylhexyl)phosphate | S-6 |
| Acetyl tributyl citrate | S-7 |
| 2,4-Di-tert-pentylphenol | S-8 |
| 2-(2-Butoxyethoxy)ethyl acetate | S-9 |
| 1,4-Cyclohexyldimethylene bis(2-ethylhexanoate) | S-10 |

The dispersions used in photographic elements may also include ultraviolet (UV) stabilizers and so called liquid UV stabilizers such as described in U.S. Pat. Nos. 4,992,358; 4,975,360; and 4,587,346. Examples of UV stabilizers are shown below.

UV-1

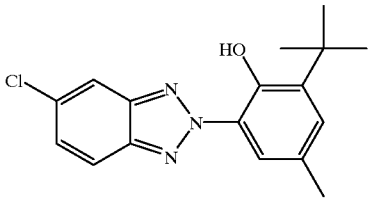

-continued

UV-2

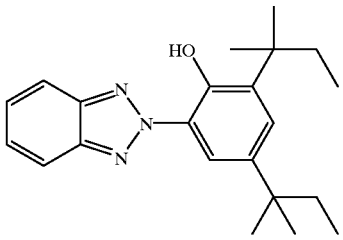

UV-3

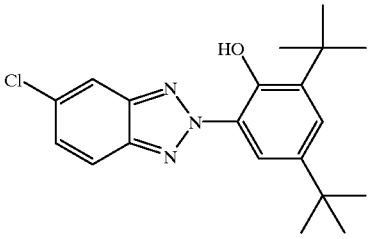

UV-4

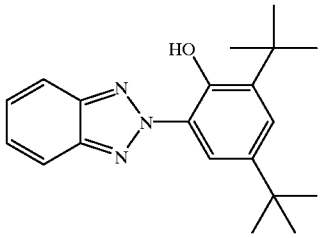

UV-5

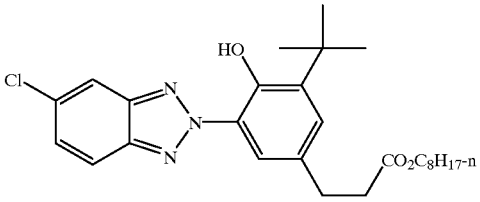

UV-6

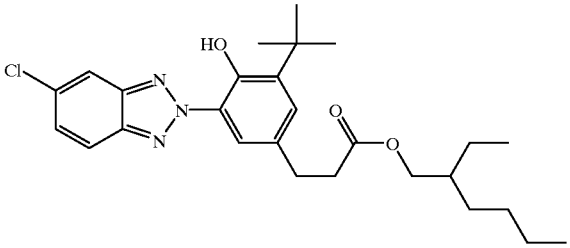

UV-7

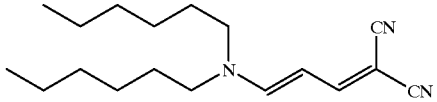

UV-8

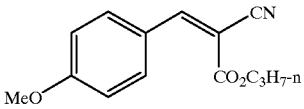

It is preferred that the UV absorber be in the cyan layer or in a layer above the dye forming layers. A layer between the surface SOC layer and the upper image forming layer is preferred for effective UV control. Most preferred is the placement of UV absorbers in the upper surface protective layer (SOC layer), as they are most effective in this layer and a separate overlayer coating is not required.

The aqueous phase may include surfactants. Surfactant may be cationic, anionic, zwitterionic or non-ionic. Useful surfactants include, but are not limited to, the following:

SF-1

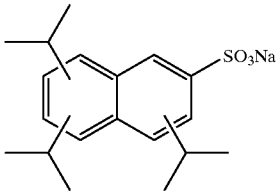

SF-2

$CF_3 \cdot (CF_2)_7 \cdot SO_3Na$

SF-3

$CH_3 \cdot (CH_2)_n \cdot SO_3Na$, n = 12-14

SF-4

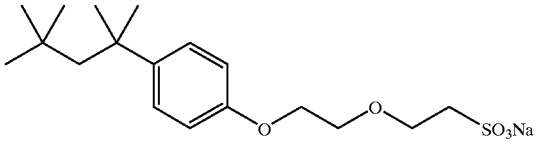

SF-5

$CH_3 \cdot (CH_2)_{11} \cdot OSO_3Na$

SF-6

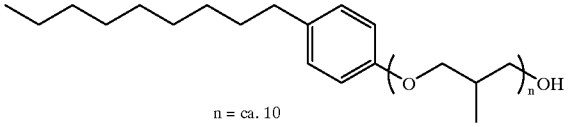

n = ca. 10

SF-7

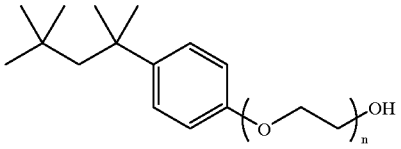

n = ca. 40

SF-8

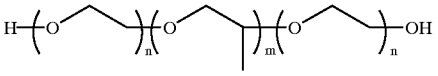

n = ca. 6, m = ca. 2

SF-9

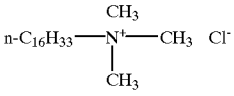

SF-10

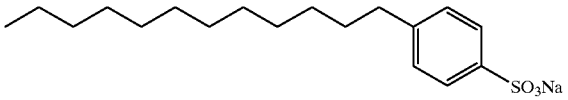

SF-11

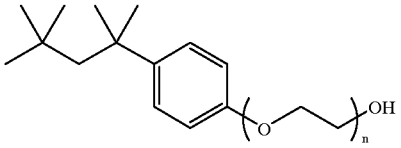

n = ca. 10

-continued

SF-12

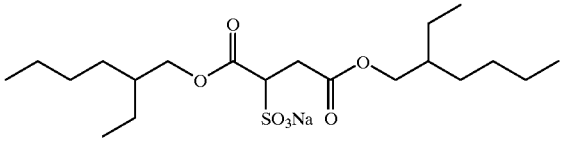

Further, it is contemplated to stabilize photographic dispersions prone to particle growth through the use of hydrophobic, photographically inert compounds such as disclosed by Zengerle et al in U.S. Ser. No. 07/978,104.

The photographic elements may also contain filter dye layers comprising colloidal silver sol or yellow, cyan, and/or magenta filter dyes, either as oil-in-water dispersions, latex dispersions or as solid particle dispersions. Useful examples of absorbing materials are discussed in *Research Disclosure*, September 1996, Item 38957, Section VIII.

The photographic elements may also contain light absorbing materials that can increase sharpness and be used to control speed and minimum density. Examples of useful absorber dyes are described in U.S. Pat. No. 4,877,721; U.S. Pat. No. 5,001,043; U.S. Pat. No. 5,153,108; and U.S. Pat. No. 5,035,985. Solid particle dispersion dyes are described in U.S. Pat. Nos. 4,803,150; 4,855,221; 4,857,446; 4,900,652; 4,900,653; 4,940,654; 4,948,717; 4,948,718; 4,950,586; 4,988,611; 4,994,356; 5,098,820; 5,213,956; 5,260,179; 5,266,454. Useful dyes include, but are not limited to, the following:

DYE-1

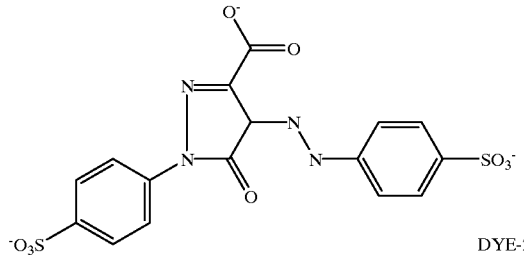

DYE-2

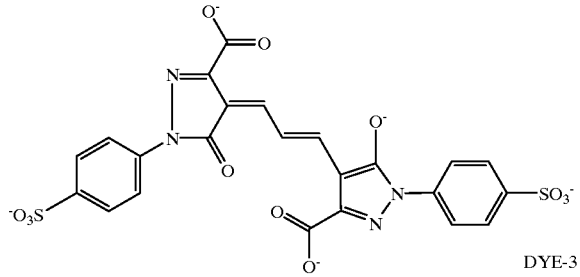

DYE-3

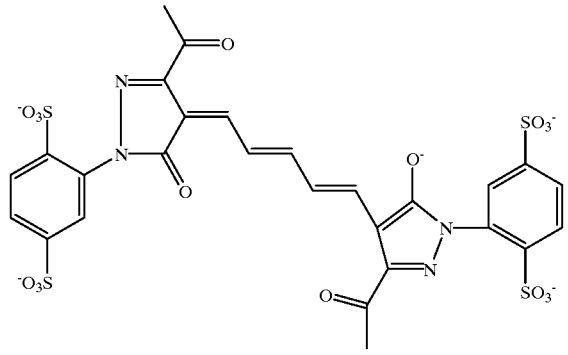

-continued

DYE-4

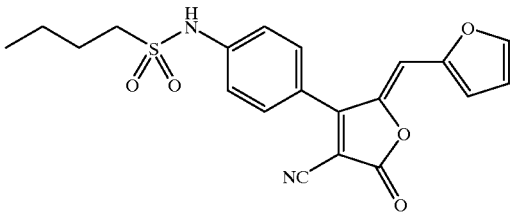

DYE-5

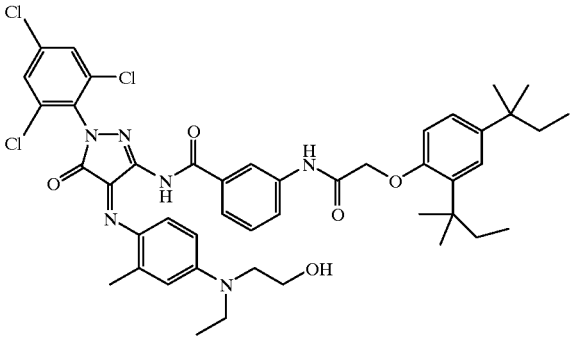

DYE-6

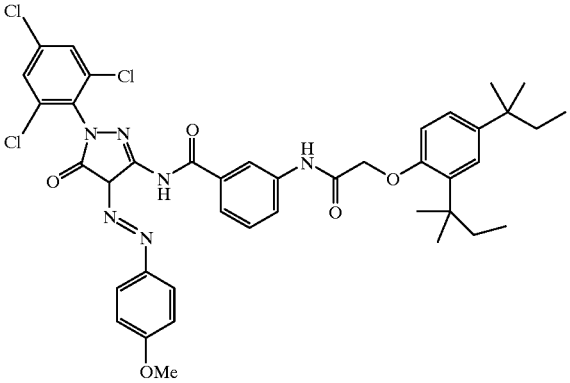

DYE-7

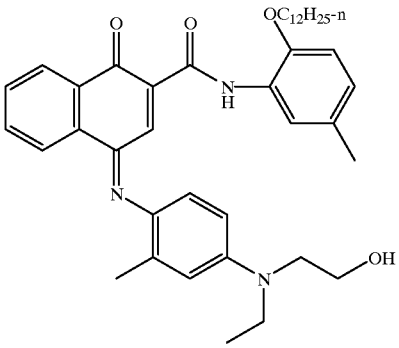

-continued

DYE-8

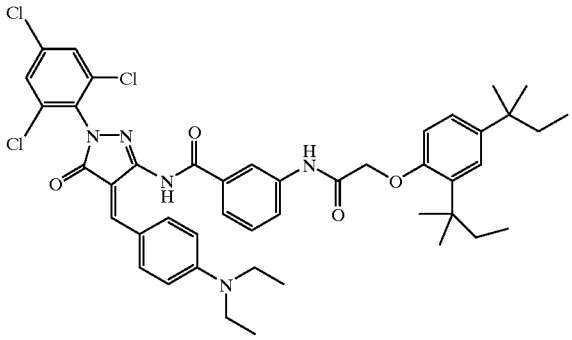

DYE-9

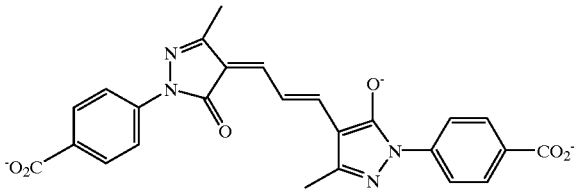

Conventional features that can be incorporated into multilayer (and particularly multicolor) recording elements contemplated for use in the method of the invention are illustrated by *Research Disclosure*, Item 38957, cited above:

XI. Layers and layer arrangements

XII. Features applicable only to color negative

XIII. Features applicable only to color positive

B. Color reversal

C. Color positives derived from color negatives

XIV. Scan facilitating features.

The recording elements comprising the radiation sensitive high chloride emulsion layers according to this invention can be conventionally optically printed, or in accordance with a particular embodiment of the invention can be image-wise exposed in a pixel-by-pixel mode using suitable high energy radiation sources typically employed in electronic printing methods. Suitable actinic forms of energy encompass the ultraviolet, visible and infrared regions of the electromagnetic spectrum as well as electron-beam radiation and is conveniently supplied by beams from one or more light emitting diodes or lasers, including gaseous or solid state lasers. Exposures can be monochromatic, orthochromatic or panchromatic. For example, when the recording element is a multilayer multicolor element, exposure can be provided by laser or light emitting diode beams of appropriate spectral radiation, for example, infrared, red, green or blue wavelengths, to which such element is sensitive. Multicolor elements can be employed which produce cyan, magenta and yellow dyes as a function of exposure in separate portions of the electromagnetic spectrum, including at least two portions of the infrared region, as disclosed in the previously mentioned U.S. Pat. No. 4,619,892. Suitable exposures include those up to 2000 nm, preferably up to 1500 nm. Suitable light emitting diodes and commercially available laser sources are known and commercially available. Imagewise exposures at ambient, elevated or reduced temperatures and/or pressures can be employed within the useful response range of the recording element determined by conventional sensitometric techniques, as illustrated by T. H. James, *The Theory of the Photographic Process*, 4th Ed., Macmillan, 1977, Chapters 4, 6, 17, 18 and 23.

It has been observed that anionic $[MX_xY_yL_z]$ hexacoordination complexes, where M is a group 8 or 9 metal (preferably iron, ruthenium or iridium), X is halide or pseudohalide (preferably Cl, Br or CN) x is 3 to 5, Y is $H_2O$, y is 0 or 1, L is a C—C, H—C or C—N—H organic ligand, and Z is 1 or 2, are surprisingly effective in reducing high intensity reciprocity failure (HIRF), low intensity reciprocity failure (LIRF) and thermal sensitivity variance and in in improving latent image keeping (LIK). As herein employed HIRF is a measure of the variance of photographic properties for equal exposures, but with exposure times ranging from $10^{-1}$ to $10^{-6}$ second. LIRF is a measure of the varinance of photographic properties for equal exposures, but with exposure times ranging from $10^{-1}$ to 100 seconds. Although these advantages can be generally compatible with face centered cubic lattice grain structures, the most striking improvements have been observed in high (>50 mole %, preferably≧90 mole %) chloride emulsions. Preferred C—C, H—C or C—N—H organic ligands are aromatic heterocycles of the type described in U.S. Pat. No. 5,462,849. The most effective C—C, H—C or C—N—H organic ligands are azoles and azines, either unsustituted or containing alkyl, alkoxy or halide substituents, where the alkyl moieties contain from 1 to 8 carbon atoms. Particularly preferred azoles and azines include thiazoles, thiazolines and pyrazines.

The quantity or level of high energy actinic radiation provided to the recording medium by the exposure source is generally at least $10^{-4}$ ergs/cm$^2$, typically in the range of about $10^{-4}$ ergs/cm$^2$ to $10^{-3}$ ergs/cm$^2$ and often from $10^{-3}$ ergs/cm$^2$ to $10^2$ ergs/cm$^2$. Exposure of the recording element in a pixel-by-pixel mode as known in the prior art persists for only a very short duration or time. Typical maximum exposure times are up to 100$\mu$ seconds, often up to 10$\mu$ seconds, and frequently up to only 0.5$\mu$ seconds. Single or multiple exposures of each pixel are contemplated. The pixel density is subject to wide variation, as is obvious to those skilled in the art. The higher the pixel density, the sharper the images can be, but at the expense of equipment complexity. In general, pixel densities used in conventional electronic printing methods of the type described herein do not exceed $10^7$ pixels/cm$^2$ and are typically in the range of about $10^4$ to $10^6$ pixels/cm$^2$. An assessment of the technology of high-quality, continuous-tone, color electronic printing using silver halide photographic paper which discusses various features and components of the system, including exposure source, exposure time, exposure level and pixel density and other recording element characteristics is provided in Firth et al., *A Continuous-Tone Laser Color Printer*, Journal of Imaging Technology, Vol. 14, No. 3, June 1988, which is hereby incorporated herein by reference. As previously indicated herein, a description of some of the details of conventional electronic printing methods comprising scanning a recording element with high energy beams such as light emitting diodes or laser beams, are set forth in Hioki U.S. Pat. No. 5,126,235, European Patent Applications 479 167 A1 and 502 508 A1.

Once imagewise exposed, the recording elements can be processed in any convenient conventional manner to obtain a viewable image. Such processing is illustrated by *Research Disclosure*, Item 38957, cited above:

XVIII. Chemical development systems

XIX. Development

XX. Desilvering, washing, rinsing and stabilizing

In addition, a useful developer for the inventive material is a homogeneous, single part developing agent. The homogeneous, single-part color developing concentrate is prepared using a critical sequence of steps:

In the first step, an aqueous solution of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from about 15:85 to about 50:50.

In this environment, especially at high alkalinity, alkali metal ions and sulfate ions form a sulfate salt that is precipitated in the presence of the hydroxy-containing organic solvent. The precipitated sulfate salt can then be readily removed using any suitable liquid/solid phase separation technique (including filtration, centrifugation or decantation). If the antioxidant is a liquid organic compound, two phases may be formed and the precipitate may be removed by discarding the aqueous phase.

The color developing concentrates of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in *Research Disclosure*, publication 38957, pages 592–639 (September 1996). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*".

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-p-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono-and polysaccharides, mono- and polyamines, quaternary ammonium salts, nitroxy radicals, alcohols, and oximes. Also useful as antioxidants are 1,4-cyclohexadiones. Mixtures of compounds from the same or different classes of antioxidants can also be used if desired.

Especially useful antioxidants are hydroxylamine derivatives as described for example, in U.S. Pat. Nos. 4,892,804; 4,876,174; 5,354,646; and 5,660,974, all noted above, and U.S. Pat. No. 5,646,327 (Bums et al). Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents.

More preferably, the noted hydroxylamine derivatives can be mono- or dialkylhydroxylamines having one or more hydroxy substituents on the one or more alkyl groups. Representative compounds of this type are described, for example, in U.S. Pat. No. 5,709,982 (Marrese et al), as having the structure I:

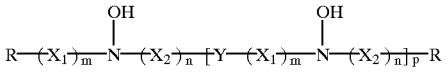

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_1$— and $X_2$ is —$CHR_1CR_2(OH)$— wherein $R_1$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis( 2-methyl-2,3-dihydroxypropyl)hydroxylamine and N,N-bis(1-hydroxymethyl-2-hydroxy-3-phenylpropyl)hydroxylamine. The first compound is preferred.

The following examples illustrate the practice of this invention. They are not intended to be exhaustive of all possible variations of the invention. Parts and percentages are by weight unless otherwise indicated.

The following examples illustrate the improvement in efficiency of silver usage with the invention structure. Comparison Example 1 (Tables 1 and 2) has a conventional scavenger interlayer structure in which all coupler resides in the light sensitive layers. Comparison Example 2 (Tables 3 and 4) has a dye-forming yellow interlayer (layer 2) in addition to scavenger containing interlayers (layers 3 and 5). Invention example 1 has coupler containing interlayers as shown in Tables 5 and 6. Comparison and invention examples have similar amounts of magenta coupler.

Two methods were employed to obtain separation characteristic dye curves for each color record. In the first method, the paper was separately exposed by a scanning laser device at the following wavelengths: 476 nm, 543 nm, and 690 nm. Exposure time per pixel was 1 microsecond, resolution was 250 pixels/inch, spot size was nominally 100$\mu$ diameter, and modulation was acousto-optic.

The second method employed a conventional tungsten exposure. Exposure time was 0.4 seconds at 1700 Lux, the color temperature was 3000K, and the beam was filtered with a Hoya 50 heat absorber. The exposure was modulated by a 0–3, 0.15 increment carbon tablet. Separations were obtained using a Wratten 70 filter for the red, a Wratten 99 plus a 0.3ND filter for the green, and a Wratten 48 plus Wratten 2B plus a 0.8ND filter for the blue.

In both methods, development was 45 seconds in a standard RA4 process.

Comparison Example 1

The multilayer structure of Comparison example 1 is illustrated in Table 1 and Table 2.

Silver chloride emulsions were chemically and spectrally sensitized as described below.

Blue Sensitive Emulsion (Blue EM-1, prepared similarly to that described in U.S. Pat. No. 5,252,451, column 8, lines 55–68): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.76 $\mu$m in edge length size. This emulsion was optimally sensitized by the addition of a colloidal suspension of aurous sulfide and heat ramped up to 60° C. during which time blue sensitizing dye BSD-4, 1-(3-acetamidophenyl)-5-mercaptotetrazole, and potassium bromide were added. In addition, iridium dopant was added during the sensitization process.

Green Sensitive Emulsion (Green EM-1): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation for most of the precipitation, followed by a shelling without dopant. The resultant emulsion contained cubic shaped grains of 0.30 $\mu$m in edge length size. This emulsion was optimally sensitized by addition of a colloidal suspension of aurous sulfide, heat digestion, followed by the addition of iridium dopant, Lippmann bromide/1-(3-acetamidophenyl)-5-mercaptotetrazole, green sensitizing dye GSD-1, and 1-(3-acetamidophenyl)-5-mercaptotetrazole.

Red Sensitive Emulsion (Red EM-1): A high chloride silver halide emulsion was precipitated by adding approximately equimolar silver nitrate and sodium chloride solutions into a well-stirred reactor containing gelatin peptizer and thioether ripener. The resultant emulsion contained cubic shaped grains of 0.40 $\mu$m in edge length size. This emulsion was optimally sensitized by the addition of a colloidal suspension of aurous sulfide followed by a heat ramp, and further additions of 1-(3-acetamidophenyl)-5-mercaptotetrazole, potassium bromide and red sensitizing dye RSD-1. In addition, iridium and ruthenium dopants were added during the sensitization process.

Coupler dispersions were emulsified by methods well known to the art, and the following layers were coated on a polyethylene resin coated paper support, that was sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl) stilbene and 4,4'-bis(2-benzoxazolyl) stilbene, 12.5% $TiO_2$, and 3% ZnO white pigment. The layers were hardened with bis (vinylsulfonyl methyl) ether at 1.95% of the total gelatin weight.

Comparison Example 2

The multilayer structure of Comparison Example 2 is represented by Table 3 and Table 4. In this case, a non-light sensitive interlayer (Layer 2) containing yellow coupler lies below a discrete scavenger interlayer (Layer 3), as described U.S. Ser. No. 08/792,496 filed Jan. 31, 1997.

Silver chloride emulsions were chemically and spectrally sensitized as described for Comparison Example 1.

Invention Example 1

The structure of Invention Example 1 is illustrated in Table 5 and Table 6. Invention Example 1 has no scavenger in the interlayers separating the light sensitive layers.

Silver chloride emulsions (>95% Cl) were chemically and spectrally sensitized as is described below.

Blue Sensitive Emulsion (Blue EM-4): A silver chloride emulsion was precipitated by adding approximately equimolar silver nitrate and sodium chloride solutions into a well-stirred reactor containing gelatin peptizer and thioether ripener. $Cs_2Os(NO)Cl_5$ dopant was added during the make. The resultant emulsion contained cubic shaped grains of 0.8 $\mu$m in edge length size. This emulsion was optimally sensitized by the addition of a colloidal suspension of aurous sulfide and heat ramped up to 60° C. during which time blue sensitizing dye BSD-2 and Lippmann bromide/1-(3-acetamidophenyl)-5-mercapto-tetrazole were added. In addition, 1-(3-acetamidophenyl)-5-mercaptotetrazole and iridium dopant were added during the sensitization process.

Green Sensitive Emulsion (Green EM-4): A high chloride silver halide emulsion was precipitated by adding approximately equimolar silver nitrate and sodium chloride solutions into a well-stirred reactor containing oxidized gelatin peptizer. $Cs_2Os(NO)Cl_5$ dopant and iridium were added during the silver halide grain formation. The resultant emulsion contained cubic shaped grains of 0.39 $\mu$m in edgelength size. This emulsion was optimally sensitized by the addition of green sensitizing dye GSD-1 followed by addition of a solution of gold(I) and sulfur, followed by heat digestion. The mixture was cooled to 40° C. followed by addition of 1-(3-acetamidophenyl)-5-mercaptotetrazole and potassium bromide.

Red Sensitive Emulsion (Red EM-4): A high chloride silver halide emulsion was precipitated by adding approximately equimolar silver nitrate and sodium chloride solutions into a well-stirred reactor containing gelatin peptizer and thioether ripener. $Cs_2Os(NO)Cl_5$ dopant was added during the silver halide grain formation. The resultant emulsion contained cubic shaped grains of 0.40 $\mu$m in edge length size. This emulsion was optimally sensitized by the addition of supersensitizer SS-1 (or alternatively with SS-2 instead of SS-1) followed by heat ramp to 65° C., followed by addition of Lippmann Bromide containing iridium dopant (.047 mg/mole Silver) and a colloidal suspension of aurous sulfide and a small amount of RSD-1 then followed by 1-(3-acetamidophenyl)-5-mercaptotetrazole. The mixture was then cooled to 40° C.

Coupler dispersions were emulsified, and the following layers were coated on a polyethylene resin coated paper support, that was sized as described in U.S. Pat. No. 4,994,147 and pH adjusted as described in U.S. Pat. No. 4,917,994. The polyethylene layer coated on the emulsion side of the support contained a mixture of 0.1% (4,4'-bis(5-methyl-2-benzoxazolyl) stilbene and 4,4'-bis(2-benzoxazolyl) stilbene, 12.5% $TiO_2$, and 3% ZnO white pigment. The layers were hardened with bis(vinylsulfonyl methyl) ether at 2.0% of the total gelatin weight. AgX laydowns are with respect to the amount of Ag.

TABLE 1

| LAYER | |
|---|---|
| 7 | OVERCOAT |
| 6 | UY + SCAVENGER INTERLAYER |
| 5 | RED LIGHT SENSITIVE LAYER |
| 4 | UV + SCAVENGER INTERLAYER |
| 3 | GREEN LIGHT SENSITIVE LAYER |
| 2 | SCAVENGER INTERLAYER |
| 1 | BLUE LIGHT SENSITIVE LAYER |
| 0 | SUPPORT |

TABLE 2

Structure of Comparison Example 3

| | | g/m$^2$ |
|---|---|---|
| Layer 1: Blue Sensitive Layer | | |
| Gelatin | | 1.507 |
| Blue Light Sensitive Silver (Blue EM-1) | | 0.291 |
| Y-1 | | 1.076 |
| ST-6 | | 0.258 |
| S-2 | | 0.355 |
| S-9 | | 0.301 |
| ST-23 | | 0.002 |
| ST-24 | | 0.00013 |
| ST-16 | | 0.009 |
| DYE-1 | | 0.018 |
| Layer 2: Interlayer | | |
| Gelatin | | 0.753 |
| ST-4 | | 0.066 |
| S-2 | | 0.187 |
| ST-15 | | 0.065 |
| SF-1 | | 0.002 |
| Layer 3: Green Sensitive Layer | | |
| Gelatin | | 1.238 |
| Green Light Sensitive Silver (Green EM-1) | | 0.122 |
| M-7 | | 0.291 |
| S-2 | | 0.261 |
| ST-21 | | 0.113 |
| ST-8 | | 0.113 |
| ST-22 | | 0.195 |
| ST-24 | | 0.001 |
| DYE-2 | | 0.018 |
| Layer 4: UV layer | | |
| Gelatin | 68.44 | 0.737 |
| UV-1 | 3.068 | 0.033 |
| UV-2 | 17.3991 | 0.187 |
| S-10 | 6.8145 | 0.073 |
| ST-4 | 5.133 | 0.055 |
| Layer 5: Red Sensitive Layer | | |
| Gelatin | 133 | 1.432 |
| Red Light Sensitive Silver (Red EM-1) | 23.58 | 0.254 |
| C-1 | 39.31 | 0.423 |
| S-2 | 38.53 | 0.415 |

TABLE 2-continued

| Structure of Comparison Example 3 | | |
|---|---|---|
| | g/m² | |
| S-9 | 3.22 | 0.035 |
| UV-2 | 25.31 | 0.27244 |
| ST-4 | 0.33 | 0.00355 |
| DYE-3 | 4.844 | 0.05214 |
| Layer 6: UV layer | | |
| Gelatin | 47.56 | 0.512 |
| UV-1 | 2.132 | 0.023 |
| UV-2 | 12.0909 | 0.130 |
| S-10 | 4.7355 | 0.051 |
| ST-4 | 3.567 | 0.038 |
| Layer 7: Overcoat | | |
| Gelatin | 100 | 1.076 |
| ST-4 | 1.2 | 0.013 |
| S-2 | 3.6 | 0.039 |
| SF-1 | 0.84 | 0.009 |
| SF-2 | 0.35 | 0.004 |

TABLE 3

| LAYER | |
|---|---|
| 8 | OVERCOAT |
| 7 | UV + SCAVENGER INTERLAYER |
| 6 | RED LIGHT SENSITIVE LAYER |
| 5 | UV + SCAVENGER INTERLAYER |
| 4 | GREEN LIGHT SENSITIVE LAYER |
| 3 | SCAVENGER INTERLAYER |
| 2 | YELLOW DYE FORMING INTERLAYER |
| 1 | BLUE LIGHT SENSITIVE LAYER |
| 0 | SUPPORT |

TABLE 4

| Structure of Comparison Example 1 | |
|---|---|
| | g/m² |
| Layer 1: Blue Sensitive Layer | |
| Gelatin | 1.220 |
| Blue Light Sensitive Silver, (Blue EM-2) | 0.440 |
| Y-1 | 0.753 |
| ST-6 | 0.181 |
| S-2 | 0.249 |
| S-9 | 0.211 |
| ST-23 | 0.002 |
| ST-24 | 0.00009 |
| ST-16 | 0.007 |
| DYE-1 | 0.006 |
| Layer 2: Yellow Coupler Interlayer | |
| Gelatin | 0.287 |
| Y-1 | 0.323 |
| ST-6 | 0.078 |
| S-2 | 0.107 |
| S-9 | 0.090 |
| ST-23 | 0.001 |
| ST-24 | 0.00004 |
| ST-16 | 0.003 |
| Layer 3: Scavenger Interlayer | |
| Gelatin | 0.753 |
| ST-4 | 0.066 |
| S-2 | 0.187 |
| ST-15 | 0.065 |
| SF-1 | 0.002 |

TABLE 4-continued

| Structure of Comparison Example 1 | |
|---|---|
| | g/m² |
| Layer 4: Green Sensitive Layer | |
| Gelatin | 1.238 |
| Green Light Sensitive Silver, (Green EM-2) | 0.179 |
| M-7 | 0.291 |
| S-2 | 0.261 |
| ST-21 | 0.113 |
| ST-8 | 0.113 |
| ST-22 | 0.195 |
| ST-24 | 0.001 |
| DYE-2 | 0.006 |
| BIO-1 | 7.212E-05 |
| Layer 5: Scavenger layer | |
| Gelatin | 0.737 |
| ST-4 | 0.055 |
| UV-1 | 0.033 |
| UV-2 | 0.187 |
| S-10 | 0.073 |
| S-2 | 0.055 |
| Layer 6: Red Sensitive Layer | |
| Gelatin | 1.432 |
| Red Light Sensitive Silver (Red EM-2) | 0.296 |
| C-1 | 0.423 |
| S-2 | 0.415 |
| S-9 | 0.035 |
| UV-2 | 0.27244 |
| ST-4 | 0.00355 |
| DYE-3 | 0.02045 |
| Layer 7: Scavenger layer | |
| Gelatin | 0.512 |
| ST-4 | 0.038 |
| UV-1 | 0.023 |
| UV-2 | 0.130 |
| S-10 | 0.051 |
| S-2 | 0.038 |
| Layer 8: Overcoat | |
| Gelatin | 1.076 |
| ST-4 | 0.013 |
| S-2 | 0.039 |
| SF-1 | 0.009 |
| SF-2 | 0.004 |

TABLE 5

| LAYER | |
|---|---|
| 8 | OVERCOAT |
| 7 | RED LIGHT SENSITIVE + CYAN DYE FORMING LAYER |
| 6 | CYAN DYE FORMING INTERLAYER |
| 5 | MAGENTA DYE FORMING INTERLAYER |
| 4 | GREEN LIGHT SENSITIVE + MAGENTA DYE FORMING LAYER |
| 3 | MAGENTA DYE FORMING INTERLAYER |
| 2 | YELLOW DYE FORMING INTERLAYER |
| 1 | BLUE LIGHT SENSITIVE + YELLOW DYE FORMING LAYER |
| 0 | SUPPORT |

TABLE 6

| Structure of Invention Example 1. | g/m$^2$ |
|---|---|
| Layer 1: Blue Light Sensitive Layer | |
| Gelatin | 1.238 |
| Blue light sensitive silver (Blue EM-4) | 0.248 |
| Y-5 | 0.323 |
| Potassium Chloride | 0.020 |
| S-1 | 0.145 |
| ST-23 | 0.002 |
| ST-16 | 0.006 |
| ST-24 | 0.000 |
| SF-1 | 0.026 |
| t-butylacrylamide-co-butylacryalte polymer | 0.323 |
| Layer 2: Yellow Dye-Forming Interlayer (YI) | |
| Gelatin | 0.775 |
| Y-5 | 0.215 |
| S-1 | 0.097 |
| t-butylacrylamide-co-n-butylacryalte polymer | 0.215 |
| SF-1 | 0.024 |
| UV-1 | 0.019 |
| UV-2 | 0.108 |
| S-8 | 0.042 |
| Layer 3: Magenta Dye-Forming Bottom | |
| Interlayer (MBI) | |
| Gelatin | 0.700 |
| M-7 | 0.108 |
| S-1 | 0.038 |
| ST-21 | 0.082 |
| ST-8 | 0.029 |
| ST-22 | 0.273 |
| UV-1 | 0.019 |
| UV-2 | 0.108 |
| S-8 | 0.042 |
| SF-1 | 0.007 |
| Layer 4: Green Light Sensitive Layer | |
| Gelatin | 0.753 |
| Green light sensitive silver (Green EM-4) | 0.108 |
| M-7 | 0.161 |
| S-1 | 0.057 |
| ST-21 | 0.123 |
| ST-8 | 0.043 |
| ST-22 | 0.410 |
| Potassium Chloride | 0.020 |
| ST-24 | 2.153E-04 |
| Layer 5: Magenta Dye-Forming Top | |
| Interlayer (MTI) | |
| Gelatin | 0.700 |
| M-7 | 0.108 |
| S-1 | 0.038 |
| ST-21 | 0.082 |
| ST-8 | 0.029 |
| ST-22 | 0.273 |
| UV-1 | 0.019 |
| UV-2 | 0.108 |
| S-8 | 0.042 |
| SF-1 | 0.007 |
| Layer 6: Cyan Dye-Forming Interlayer | |
| (CI) | |
| Gelatin | 0.840 |
| C-3 | 0.108 |
| S-1 | 0.105 |
| S-5 | 0.009 |
| ST-15 | 0.009 |
| UV-1 | 0.019 |
| UV-2 | 0.108 |
| S-8 | 0.042 |
| SF-1 | 0.007 |

TABLE 6-continued

| Structure of Invention Example 1. | g/m$^2$ |
|---|---|
| Layer 7: Red Light Sensitive Layer | |
| Gelatin | 1.184 |
| Red Light Sensitive Silver (Red EM-4) | 0.237 |
| C-3 | 0.323 |
| S-1 | 0.316 |
| S-5 | 0.026 |
| Potassium tolyithiosulfonate | 0.00165 |
| ST-24 | 0.00006 |
| UV-1 | 0.019 |
| UV-2 | 0.108 |
| S-8 | 0.042 |
| SF-1 | 0.007 |
| Layer 8: Overcoat | |
| Gelatin | 1.076 |
| ST-4 | 0.013 |
| S-1 | 0.039 |
| SF-1 | 0.009 |
| SF-2 | 0.004 |
| AD-1 | 0.004 |
| AD-2 | 0.006 |
| AD-3 | 0.020 |

Table 7 compares the silver laydowns, Dmax, peak gamma (as defined in U.S. Pat. No. 5,744,287, column 5, lines 21–24), and log exposure range required to reach a density of 2.0 in the magenta color record (green light sensitive layer) when exposed at 1 microsecond. Lower silver and higher density are preferred, as illustrated by Invention Example 1.

TABLE 7

| | Green sensitive Ag (g/m$^2$) | Magenta Dmax | Peak gamma | Log Exposure range @ magenta density = 2.0 |
|---|---|---|---|---|
| Comparison Ex 1 | .122 | >1.79 | 1.7 | >1.4 |
| Comparison Ex 2 | .179 | 2.44 | 2.6 | 1.2 |
| Invention Ex 1 | .108 | 2.55 | 3.76 | .90 |

Table 8 compares the silver laydowns, Dmax, peak gammas, and log exposure range required to reach a density of 2.0 in the green color record when exposed at 0.4 seconds, with similar results.

TABLE 8

| | Green sensitive Ag (mg/m$^2$) | Magenta Dmax | Peak gamma | Log Exposure range @ magenta density = 2.0 |
|---|---|---|---|---|
| Comparison Ex 1 | .122 | 2.28 | 2.2 | >.16 |
| Comparison Ex 2 | .179 | 2.58 | 4.0 | .93 |
| Invention Ex 1 | .108 | 2.61 | 4.5 | .75 |

The invention has been described in detail with particular reference to certain preferred embodiments thereof, but it will be understood that variations and modifications can be effected within the spirit and scope of the invention.

What is claimed is:

1. A multilayer photographic element comprising a reflective support wherein the color record 1 adjacent to the support comprises at least one light sensitive layer and a non-light sensitive dye-forming interlayer; and wherein color record 2 above said color record 1 comprises at least one light sensitive layer and at least two non-light sensitive dye-forming interlayers and wherein color record 3 above color record 2 comprises at least one light sensitive layer and a non-light sensitive dye-forming interlayer; an optional UV dye containing interlayer; and a top overcoat; and wherein each color record of the invention multilayer structure produces after exposure and development a characteristic dye curve having the following properties at one or more exposure times in the range 20 nanoseconds to 500 seconds: the maximum slope of the characteristic dye curve has a value ranging from 2.0 to 5.0; the maximum Status A reflection density after separation exposure followed by development is >=1.0; the minimum Status A reflection density after development is <=0.300 in each color record; the log exposure range between the Dmin plateau plus +0.04 Status A density units and the Dmax plateau −0.04 Status A density units does not exceed 2.0.

2. The photographic element of claim 1 wherein each color record develops to a density of at least 2.0 within a log exposure range of 1.2 or less relative to the exposure point producing a density 0.04 above Dmin.

3. The photographic element of claim 1 wherein one color record comprises a pyrazoletriazole magenta dye forming coupler.

4. The photographic element of claim 1 wherein the total silver laydown is less than 0.70 $g/m^2$.

5. The photographic element of claim 1 wherein the total gelatin laydown is between 4.3 and 7.5 $g/m^2$.

6. The element of claim 1 wherein when said element is digitally exposed at sub microsecond times of exposure at a maximum density of 2.2 and then developed it has substantially no fringing.

7. The element of claim 1 wherein the silver halide grains comprising the light sensitive layers of the full color photographic element are comprised of at least 90 percent silver chloride and further comprise an iridium coordination complex containing a thiazole or substituted thiazole ligand.

8. The element of claim 5 further comprising a hexacoordination metal complex which satisfies the formula:

$$[ML_6]^n \quad (I)$$

wherein n is zero, −1, −2, −3 or −4;

M is a filled frontier orbital polyvalent metal ion, other than iridium; and $L_6$ represents bridging ligands which can be independently selected, provided that at least four of the ligands are anionic ligands, and at least one of the ligands is a cyano ligand or a ligand more electronegative than a cyano ligand.

9. The element of claim 1 wherein none of the silver halide containing layers contain greater than 0.25 $mg/m^2$ silver.

10. The element of claim 1 wherein the support comprises a paper substrate and at least one layer adjacent said paper comprising polyolefin polymer and a hindered amine stabilizer wherein said hindered amine stabilizer has a number average molecular weight of less than 2300.

11. The element of claim 1 wherein the support material comprises a paper substrate and at least one layer of melt extruded polyester.

12. The element of claim 1 wherein the support material comprises a paper substrate and at least one biaxially oriented polyolefin sheet laminated to said substrate.

13. The element of claim 1 wherein the interlayers contain no silver halide.

14. The element of claim 1 wherein each interlayer is substantially scavenger free, comprises silver halide grains comprising greater than 90% silver chloride, and wherein the reciprocity characteristics of the silver halide grains are such that for a separation exposure of 1 microsecond and 0.4 sec, at least one color record develops to a density of at least 2.0 within a log exposure range of 1.2 or less relative to the exposure point producing a density 0.04 above Dmin.

* * * * *